US009091989B2

(12) United States Patent
Uchiyama et al.

(10) Patent No.: US 9,091,989 B2
(45) **Date of Patent: *Jul. 28, 2015**

(54) COLOR IMAGE FORMING APPARATUS

(71) Applicant: CANON KABUSHIKI KAISHA, Tokyo (JP)

(72) Inventors: Takehiro Uchiyama, Kawasaki (JP); Takateru Ohkubo, Susono (JP); Kenji Watanabe, Suntou-gun (JP); Ken-ichi Iida, Tokyo (JP); Toshiaki Sako, Mishima (JP); Hiroshi Hagiwara, Suntou-gun (JP); Hiromitsu Kumada, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/513,791

(22) Filed: Oct. 14, 2014

(65) Prior Publication Data

US 2015/0030341 A1 Jan. 29, 2015

Related U.S. Application Data

(63) Continuation of application No. 14/026,011, filed on Sep. 13, 2013, now Pat. No. 8,891,984, which is a continuation of application No. 13/169,321, filed on Jun. 27, 2011, now Pat. No. 8,600,274.

(30) Foreign Application Priority Data

Jun. 30, 2010 (JP) ..... 2010-149479
Apr. 21, 2011 (JP) ..... 2011-095104

(51) Int. Cl.
*G03G 15/00* (2006.01)
*G03G 15/01* (2006.01)

(52) U.S. Cl.
CPC ..... *G03G 15/55* (2013.01); *G03G 15/01* (2013.01); *G03G 15/0126* (2013.01);
(Continued)

(58) Field of Classification Search
USPC ..... 399/39, 49, 116, 301
See application file for complete search history.

(56) References Cited

U.S. PATENT DOCUMENTS 5,619,308 A 4/1997 Kinoshita et al.
6,834,174 B2 12/2004 Imaizumi et al.
(Continued)

FOREIGN PATENT DOCUMENTS

CN 1851568 A 10/2006
CN 1904753 A 1/2007
(Continued)

OTHER PUBLICATIONS

Office Action in Japanese Application No. 2011-095104, dated Aug. 5, 2014.
(Continued)

*Primary Examiner* — David Gray
*Assistant Examiner* — Michael Harrison
(74) *Attorney, Agent, or Firm* — Fitzpatrick, Cella, Harper & Scinto

(57) ABSTRACT

An image forming apparatus includes a photosensitive section driven to rotate, a light emission unit configured to emit light to form electrostatic latent images on the photosensitive section, a process section configured to form images on the photosensitive section, a detection unit configured to detect an output generated via the process section when an electrostatic latent image for correction passes through a position facing the process section, and a control unit configured to execute a correction of a position of an electrostatic latent image in image formation based on a detection result from the detection unit.

31 Claims, 30 Drawing Sheets

(52) U.S. Cl.
CPC ..... *G03G 15/0131* (2013.01); *G03G 15/5037* (2013.01); *G03G 15/5058* (2013.01); *G03G 2215/00059* (2013.01); *G03G 2215/0132* (2013.01); *G03G 2215/0161* (2013.01)

(56) References Cited

U.S. PATENT DOCUMENTS

| | | | | |
|---|---|---|---|---|
| 7,389,060 | B2 | 6/2008 | Ishibashi | |
| 7,558,510 | B2 | 7/2009 | Iwasaki | |
| 7,734,234 | B2 | 6/2010 | Ikeda | |
| 7,822,366 | B2 | 10/2010 | Jeon et al. | |
| 8,155,543 | B2 | 4/2012 | Ishibashi et al. | |
| 8,600,274 | B2 * | 12/2013 | Uchiyama et al. | 399/301 |
| 2007/0196115 | A1 * | 8/2007 | Soutome | 399/16 |
| 2009/0214236 | A1 | 8/2009 | Takane | |
| 2012/0003016 | A1 | 1/2012 | Uchiyama et al. | |

FOREIGN PATENT DOCUMENTS

| | | | |
|---|---|---|---|
| CN | 101017353 | A | 8/2007 |
| JP | 5-323744 | A | 12/1993 |
| JP | 7-234612 | A | 9/1995 |
| JP | 07-306624 | A | 11/1995 |
| JP | 10-039571 | A | 2/1998 |
| JP | 10-123791 | A | 5/1998 |
| JP | 2007-79013 | A | 3/2007 |
| JP | 2007-156455 | A | 6/2007 |
| JP | 2012-014176 | A | 1/2012 |
| JP | 2012-032777 | A | 2/2012 |
| RU | 2008135872 | A | 3/2010 |

OTHER PUBLICATIONS

Office Action in Japanese Application No. 2011-164992, dated Aug. 5, 2014.

Search Report in European Patent Application No. 11171861.5, dated Aug. 27, 2014.

Office Action in Russian Application No. 2012150864, dated Jan. 27, 2014.

Office Action in Japanese Application No. 2011-164992, dated Dec. 17, 2013.

Notification of the First Office Action dated Sep. 10, 2013, in Chinese Application No. 201110182022.0.

* cited by examiner

IN THE CASE WHERE TONER IS NOT ADHERED ON ELECTROSTATIC LATENT IMAGE 80

IN THE CASE WHERE TONER IS ADHERED ON ELECTROSTATIC LATENT IMAGE 80

| FIG. 25B-1 |
| --- |
| FIG. 25B-2 |

COLOR IMAGE FORMING APPARATUS

BACKGROUND OF THE INVENTION

1. Field of the Invention

The present invention relates to a color image forming apparatus using electrophotography and particularly to an image forming apparatus capable of forming an electrostatic latent image.

2. Description of the Related Art

Among electrophotographic color image forming apparatuses, a so-called in-line system independently including image forming units for respective colors for fast printing has been known. The in-line system color image forming apparatus adopts a configuration that sequentially transfers images from the image forming units of respective colors to an intermediate transfer belt and collectively transfers the images onto a recording medium.

Such a color image forming apparatus causes misregistration (positional deviation) owing to mechanical factors in the image forming units of the respective colors when superimposing the images. In particular, in a configuration independently including laser scanners (optical scanning devices) and photosensitive drums for the respective colors, positional relationships between the laser scanners and the photosensitive drums differ among colors. Accordingly, laser scanning positions on the photosensitive drums cannot be synchronized, causing misregistration.

To correct the misregistration, in the above color image forming apparatus, misregistration correction control is executed. In Japanese Patent Application Laid-Open No. H07-234612, toner images for detection for respective colors are transferred from photosensitive drums onto an image carrier (intermediate transfer belt), and relative positions of the toner images for detection in scanning and conveying directions are detected using optical sensors and thereby misregistration correction control is executed.

SUMMARY OF THE INVENTION

However, there are following problems in detecting the toner image for detection using the optical scanner in the conventionally known misregistration correction control. That is, since a toner image for detection (density of 100%) in the misregistration correction control is used from the photosensitive drum onto the image carrier (belt), efforts to clean the drum and the carrier are required, reducing usability of the image forming apparatus.

The purpose of the invention is to solve at least one of these problems and another problem.

For instance, a purpose of the invention to resolve a problem in detecting the conventional toner image for detection by the optical sensor and enhance usability of the image forming apparatus. The other problems can be understood through the entire specification.

To solve the above problems, another purpose of the invention is to provide a color image forming apparatus comprising image forming units for each color, each of the image forming units including a photosensitive member driven to rotate, a charge section for charging the photosensitive member, a light emission section for emitting light to form an electrostatic latent image on the photosensitive member, a developing section for applying toner on the electrostatic latent image and forming a toner image on the photosensitive member, and a transfer section for transferring a toner image adhered on the photosensitive member onto a belt, the charging section the developing section and the transfer section being arranged for the photosensitive member, the color image forming apparatus including a forming section that controls the light emission section corresponding to each color and forming an electrostatic latent image for misregistration correction on each of the photosensitive members for each color, a power supply section for the charge sections, the development section or the transfer section, a detection section for detecting an output for each color, from the power supply section, when the electrostatic latent image for misregistration correction formed on the photosensitive member for each color passes through a position facing to one of the charge section, the development section and the transfer section, and a control section that performs misregistration correction control so as to return a misregistration condition to a reference condition based on a detection result from the detection section.

A further purpose of the invention is to provide a color image forming apparatus comprising image forming units for each color, each of the image forming units including a photosensitive member driven to rotate, a process unit closely provided around the photosensitive member and acting on the photosensitive member, a light emission section for executing light emission and forming an electrostatic latent image on the photosensitive member, the apparatus causing the image forming unit to operate to form a toner image, including a forming section for controlling the light emission section corresponding to each color and forming an electrostatic latent image for misregistration correction on the photosensitive member for each color, a power supply section for the process unit corresponding to each color, a detection section for detecting, for each color, an output from the power supply section when an electrostatic latent image for misregistration correction formed on the photosensitive member for each color passes through a position facing to the process unit, and a control section for executing misregistration correction control so as to return a misregistration condition to a reference condition based on a detection result from the detection section.

The present invention can resolve the problems in detecting the conventional toner image for detection by the optical sensor and enhance usability of the image forming apparatus.

A still further feature of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Hereinafter, embodiments of the present invention will exemplarily be described in detail. Note that configurational elements in the embodiments are described for an exemplary purpose. It is not intended to limit the scope of the present invention only therewithin.

Embodiment 1

[Diagram of Configuration of in-Line System (4-Drum System) Color Image Forming Apparatus]

Figure 1:
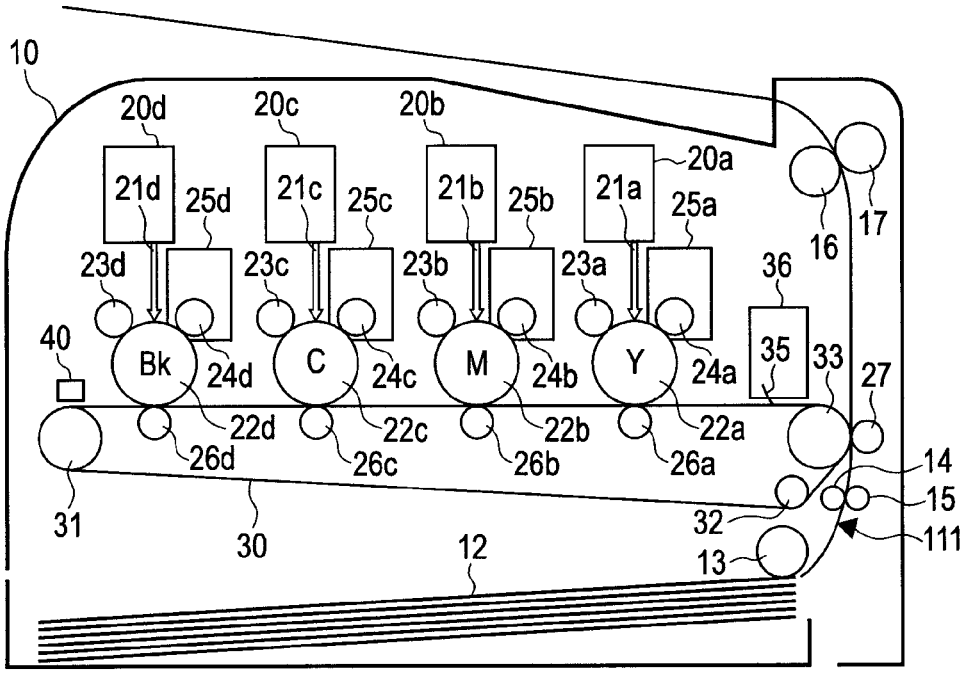
FIG. 1 is a diagram of a configuration of an in-line system (4-drum system) color image forming apparatus.

FIG. 1 is a diagram of a configuration of an in-line system (4-drum system) color image forming apparatus 10. The front end of a recording medium 12 fed by a pickup roller 13 is detected by a resist sensor 111. Subsequently, conveyance is temporarily suspended at a position where the front end has passed a little through a pair of conveying rollers 14 and 15.

Scanner units 20*a* to 20*d* sequentially emit photosensitive drums 22*a* to 22*d*, which are photosensitive members driven to rotate, with laser light beams 21*a* to 21*d*, respectively. Here, photosensitive drums 22*a* to 22*d* have preliminarily been charged by charging rollers 23*a* to 23*d*. For instance, a voltage of −1200 V is output from each charging roller. The surface of the photosensitive drum is charged to, for instance, −700 V. With this charged potential, electrostatic latent images are formed by emission of laser light beams 21*a* to 21*d*. The potential of an area on which the electrostatic latent images are formed thus becomes, for instance, −100 V. Developers 25*a* to 25*d* and developing sleeves 24*a* to 24*d* output, for instance, a voltage of −350 V, apply toner onto the electrostatic latent images on the photosensitive drums 22*a* to 22*d*, thereby forming toner images on the photosensitive drums. Primary transfer rollers 26*a* to 26*d* output, for instance, a positive voltage of +1000 V, and transfer the toner images on the photosensitive drums 22*a* to 22*d* onto an intermediate transfer belt 30 (endless belt). Note that elements directly related to formation of the toner image on the charging roller, the developer and the primary transfer roller including the scanner unit and the photosensitive drum are referred to as image forming unit. These units may be referred to as image forming units excluding the scanner units 20 in some cases. Elements (the charging rollers, the developers and the primary transfer rollers) arranged adjacent to the photosensitive drum and act on the photosensitive drum are referred to as process units. Plural types of elements can thus correspond to the process units.

The intermediate transfer belt 30 is rotationally driven by rollers 31, 32 and 33, and conveys the toner image to the position of a secondary transfer roller 27. At this time, conveyance of the recording medium 12 is restarted so as to match the timing with the conveyed toner image at the position of the secondary transfer roller 27. The secondary transfer roller 27 transfers the toner image from the intermediate transfer belt 30 onto the recording material (recording medium 12).

Subsequently, the toner image of the recording medium 12 is heated and fixed by pair of fuser rollers 16 and 17 and then the recording medium 12 is output from the apparatus. Here, the toner having not been transferred from the intermediate transfer belt 30 onto the recording medium 12 by the secondary transfer roller 27 is collected into a waste toner container 36 by a cleaning blade 35. The operation of misregistration detection sensor 40 for detecting the toner image will be described later. Here, letters a, b, c and d of symbols illustrate elements and units of yellow, magenta, cyan and black, respectively.

FIG. 1 illustrates the system in which the scanner unit executes light emission. However, without limitation thereto, in terms of occurrence of misregistration (positional deviation), an image forming apparatus including, for instance, an LED array as a light emission section may be applied to following embodiments. In the following description, a case of including a scanner unit as the light emission section will be described as an example.

[Diagram of Configuration of High-Voltage Power Supply Device]

Next, a configuration of a high-voltage power supply device in the image forming apparatus of FIG. 1 will be described using FIGS. 2A and 2B. The high-voltage power supply circuit device illustrated in FIG. 2A includes a charged high-voltage power supply circuit 43, development high-voltage power supply circuits 44*a* to 44*d*, primary transfer high-voltage power supply circuits 46*a* to 46*d*, a secondary transfer high-voltage power supply circuit 48. The charged high-voltage power supply circuit 43 applies voltage to the charging rollers 23*a* to 23*d* to form background potential on the surfaces of the photosensitive drums 22*a* to 22*d*, and realizes a condition capable of forming an electrostatic latent image by emission of laser light. The development high-voltage power supply circuits 44*a* to 44*d* apply toner onto the electrostatic latent images of the photosensitive drums 22*a* to 22*d* by applying voltage to the developing sleeves 24*a* to 24*d*, thereby forming toner images. The primary transfer high-voltage power supply circuits 46*a* to 46*d* transfer the toner images of the photosensitive drums 22*a* to 22*d* onto the intermediate transfer belt 30 by applying voltage to the primary transfer rollers 26*a* to 26*d*. The secondary transfer high-voltage power supply circuit 48 transfers the toner image on the intermediate transfer belt 30 onto the recording medium 12 by applying voltage to the secondary transfer roller 27.

The primary transfer high-voltage power supply circuits 46*a* to 46*d* include current detection circuits 47*a* to 47*d*, respectively. This is because transfer performance of the toner images on the primary transfer rollers 26*a* to 26*d* vary according to amounts of currents flowing in the primary transfer rollers 26*a* to 26*d*. It is configured such that, according to detection results of the current detection circuits 47*a* to 47*d*, bias voltages (high voltage) to be applied to the primary transfer rollers 26*a* to 26*d* are adjusted so as to maintain the transfer performance constant even if temperature and humidity in the apparatus vary. In the primary transfer, constant voltage control is executed with a target set such that the amounts of current flowing in the primary transfer rollers 26*a* to 26*d* become target values.

Figure 2A:
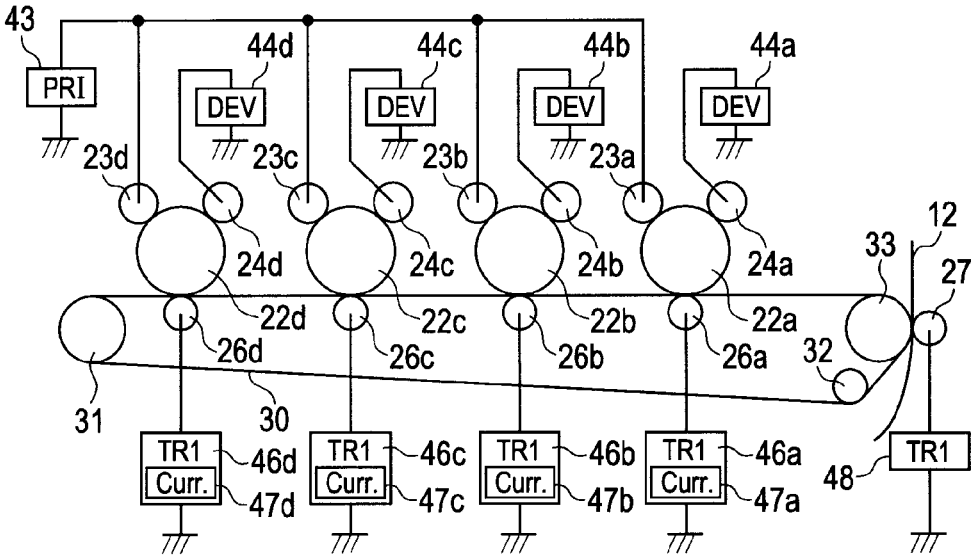
FIGS. 2A and 2B are diagrams of a configuration of a high-voltage power supply device.
Figure 2B:
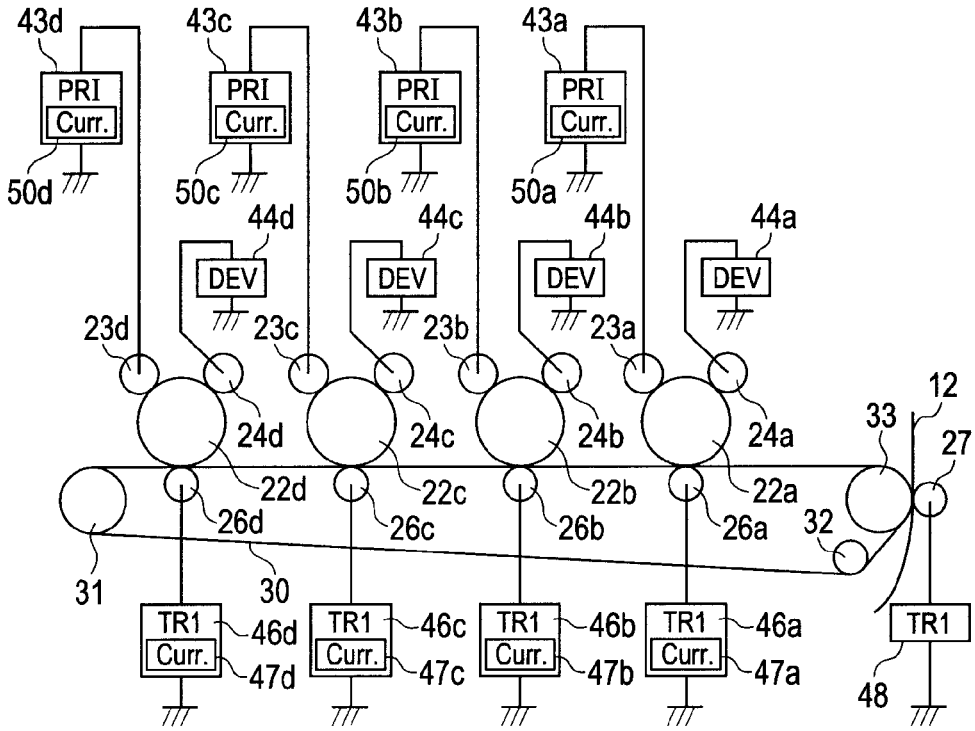

In FIG. 2B, in contrast to FIG. 2A, charged high-voltage power supply circuits 43*a* to 43*d* are separately provided for the charging rollers 23*a* to 23*d*, respectively. The charged high-voltage power supply circuits 43*a* to 43*d* are provided with current detection circuits 50*a* to 50*d*, respectively. Since the other configuration is identical to that of FIG. 2A, detailed description thereof is omitted.

[Hardware Block Diagram of Printer System]

Figure 3:
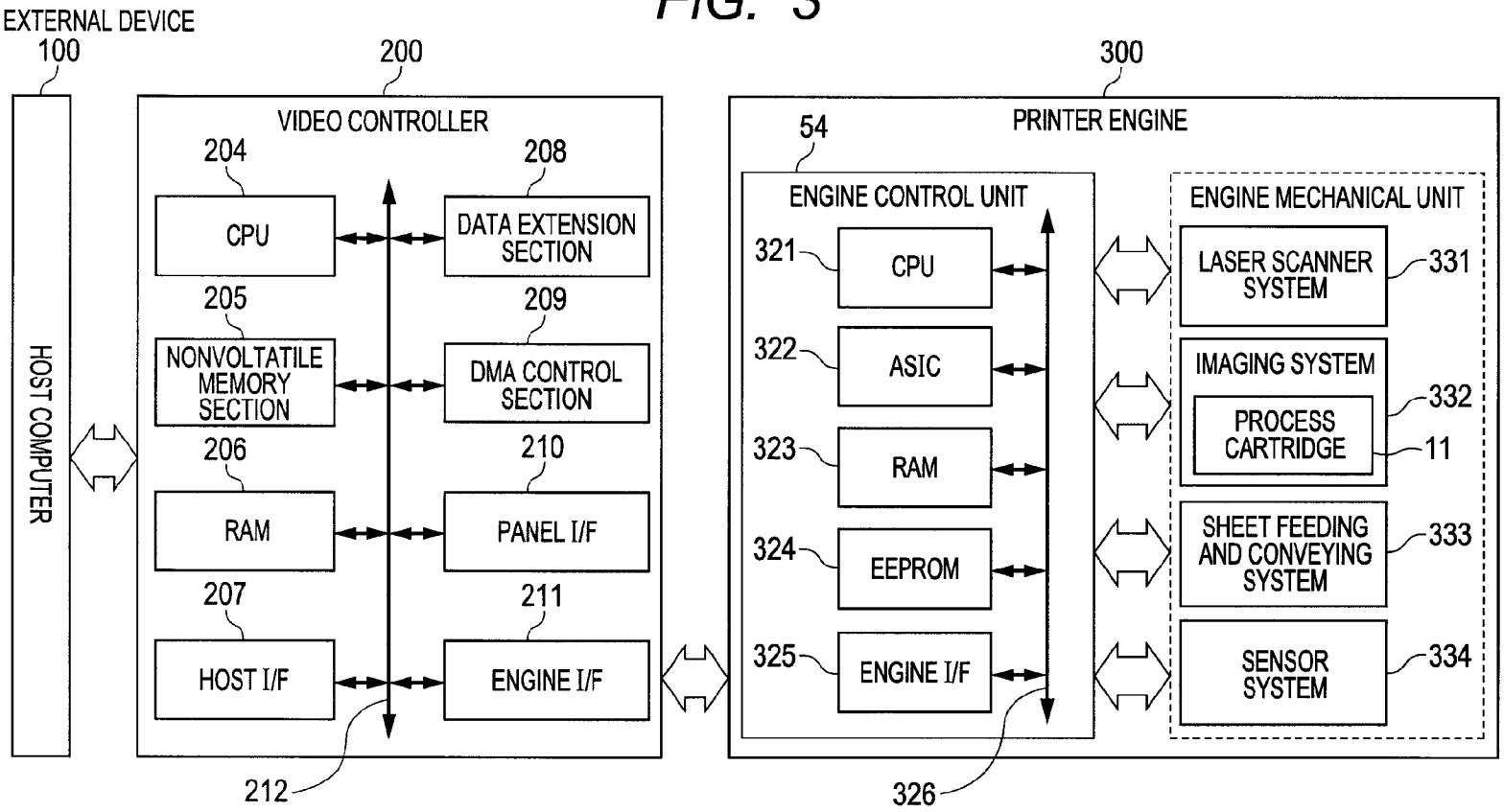
FIG. 3 is a diagram of a hardware configuration of a printer system.

Next, a typical hardware configuration of a printer system will be described using FIG. 3. First, a video controller 200 will be described. The video controller 200A includes a CPU 204 for executing the entire control of the video controller, a nonvolatile memory section 205 that stores various control codes to be executed by the CPU 204, and corresponds to a ROM, an EEPROM and a hard disk, a RAM 206 for temporary storage functions as a main memory and a work area of the CPU 204 and a host interface 207 (referred to as host I/F in the diagram) that is an input and output section of print data and control data from and to an external device 100 such as a host computer. The print data received from the host interface 207 is stored as a compressed data in the RAM 206. The video controller 200A also includes a data extension section 208 extending the compressed data, a Direct Memory Access (DMA) control section 209, a panel interface (referred to as panel I/F in the FIG. 210 and an engine interface (referred to as engine I/F in the FIG. 211. The extended image data is stored in the RAM 206. The above elements are connected to the system bus 212 including an address bus and a data bus and accessible to each other.

The data extension section 208 extends an arbitrary compressed data stored in the RAM 206 to an image data in units of lines. The Direct Memory Access (DMA) control section 209 transfers the image data in the RAM 206 to an engine interface 211 according to an instruction from the CPU 204. The panel interface 210 receives various settings and instructions from an operator through panel sections provided on main bodies of the color image forming apparatus 10 and the printer 1. The engine interface 211 is a section of inputting and outputting a signal from and to a printer engine 300, and transmits a data signal from an output buffer register, which is not illustrated, and controls communication with the printer engine 300.

Next, the printer engine 300 will be described. Broadly speaking, the printer engine 300 includes an engine control unit 54 (hereinafter, simply referred to as control unit 54) and an engine mechanical unit. The engine mechanical unit operates according to various instructions from the control unit 54. First, the engine mechanical unit will be described in detail. Subsequently, the control unit 54 will be described in detail.

A laser scanner system 331 includes a laser light emitting element, a laser driver circuit, a scanner motor, a polygon mirror and a scanner driver. The laser scanner system 331 forms a latent image on the photosensitive drum 22 by exposing the photosensitive drum 22 to laser light for scanning according to the image data transmitted from the video controller 200. The laser scanner system 331 and an after-mentioned imaging system 332 correspond to a part referred to as the image forming unit illustrated in FIG. 1. The imaging system 332 is a center of the image forming apparatus, and forms the toner image based on the latent image formed on the photosensitive drum 22 on a sheet (on the recording medium 12). The imaging system 332 includes the process units (various types of process units) acting on the photosensitive drum 22 described above. The imaging system 332 includes process elements, such as a process cartridge 11, the intermediate transfer belt 30 and a fuser, and high-voltage power supply circuits generating various types of bias (high voltage) for imaging. The imaging system 332 also includes motors for driving the elements such as, for instance, motors for driving the photosensitive drums 22.

The process cartridge 11 includes a diselectrifier, a charger 23 (charging roller 23), a developer 25 and the photosensitive drum 22. The process cartridge 11 includes a nonvolatile memory tag. One of CPU 321 and ASIC 322 reads and writes various pieces of information from and on the memory tag.

Sheet feeding and conveying system 333 controls sheet feeding and conveyance of a sheet (recording medium 12), and includes various conveying system rollers, a sheet feeding tray, a sheet output tray, various conveying rollers (such as output roller).

Sensor system 334 includes a group of sensors for collecting information that after-mentioned CPU 321 and ASIC 322 require to control the laser scanner system 331, the imaging system 332 and the sheet feeding and conveying system 333. The group of sensors at least includes various sensors, such as a temperature sensor for a fuser and a density sensor for detecting density of an image, which have already been known. The group of sensors further includes the misregistration detection sensor 40 for detecting the toner image, which has been described above. The sensor system 334 in the figure is illustrated in a manner separated into the laser scanner system 331, the imaging system 332 and the sheet feeding and conveying system 333. However, the sensor system 334 may be considered to be included in any mechanism.

Next, the control unit 54 will be described. A CPU 321 uses a RAM 323 as a main memory and a work area, and controls the above-mentioned engine mechanical unit according to various control programs stored in the EEPROM 324. More specifically, the CPU 321 drives the laser scanner system 331 based on the print control command and the image data input from the video controller 200 via the engine I/F 211 and the engine I/F 325. Note that the nonvolatile memory may be replaced with a volatile memory with a backup battery. The CPU 321 controls various print sequences by controlling the imaging system 332 and the sheet feeding and conveying system 333. The CPU 321 obtains information necessary to control the imaging system 332 and the sheet feeding and conveying system 333, by driving the sensor system 334.

The ASIC 322 execute high-voltage power supply control, such as the above-mentioned control of motors and control of development bias for executing the various print sequences, according to an instruction from the CPU 321. A system bus 326 includes an address bus and a data bus. The elements included in the control unit 54 are connected to the system bus 326 to be accessible with each each other. The entire parts or a part of functions of the CPU 321 may be executed by the ASIC 322. Instead, the entire parts or a part of functions of the ASIC 322 may be executed by the CPU 321. In the aforementioned description, although the video controller 200 and control unit 54 are explained as different components, those are achieved as a unified control unit. On the other hand, those are further segmentalized multiple control units. For example, a part of processing performed by the control unit 54 as described below, may be achieved by the CPU 204 of the video controller 200. On the contrary, the whole or a part of processing performed by the video controller 200 may be achieved by the control unit 54, while the whole or a part of processing performed by the video controller 200 and the control unit 54 may be achieved by other control units. That is, for example, in the video controller 200, the functions of the forming section to form a toner mark as a misregistration correction and an electrostatic latent image, the control section for a misregistration correction to command data collection regarding misregistration or various calculations. Also, as explained as timing T1 and timing T3 in FIG. 24, for example, the video controller 200 may achieves the function of the process unit controller to control operation or setting of each of the process unit when an electrostatic latent image is detected. The functions, the forming section F, the control section for a misregistration correction C and the process unit controller P are shown in FIG. 4B, these functions F, C and P can be achieved by various hardware.

[Circuit Diagram of High-Voltage Power Supply]

Next, a circuit configuration of the primary transfer high-voltage power supply circuit 46*a* of the high-voltage power supply device in FIGS. 2A and 2B will be described using FIG. 4A. Since the primary transfer high-voltage power supply circuits 46*b* to 46*d* for the other colors have the same circuit configuration, the description thereof is omitted.

Figure 4A:
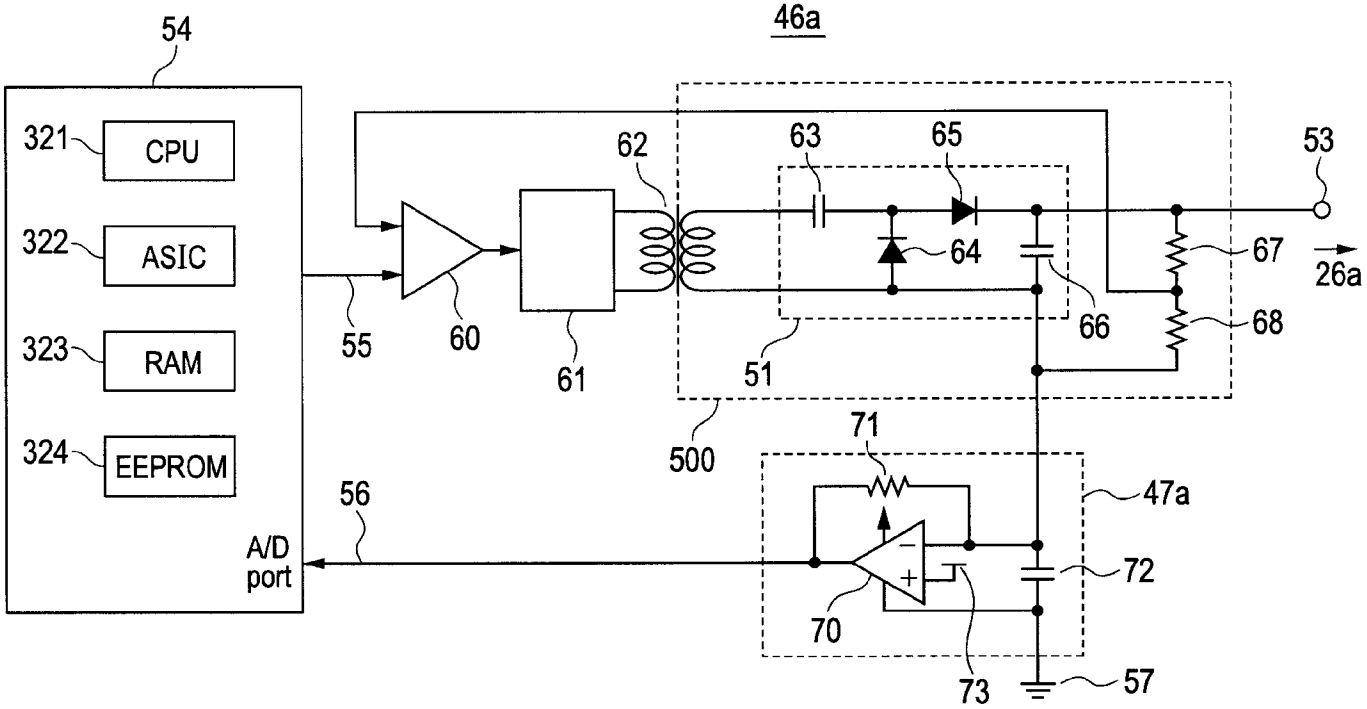
FIG. 4A is a circuit diagram of a high-voltage power supply.
Figure 4B:
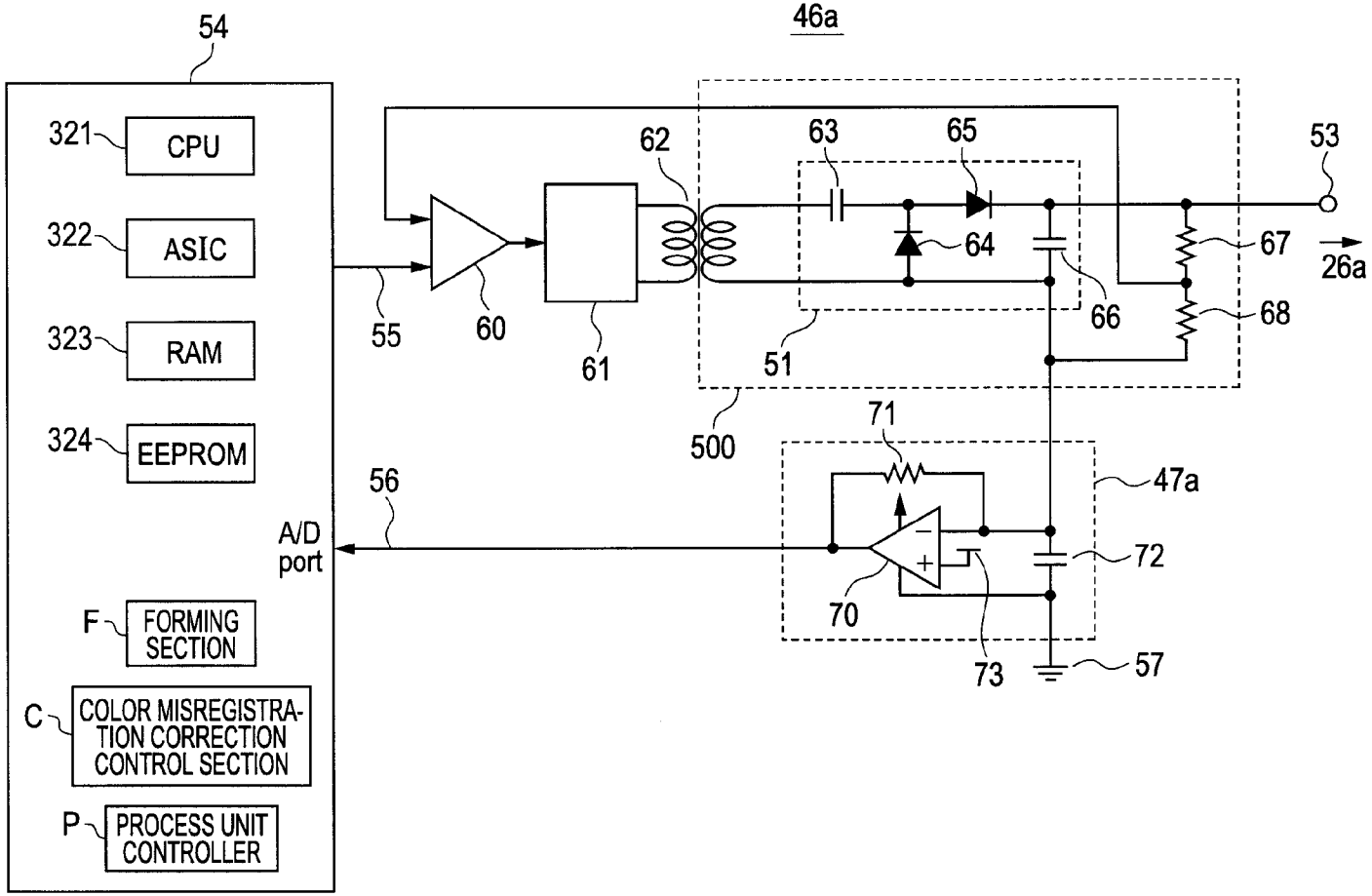
FIG. 4B shows a functional block diagram of a high-voltage power supply circuit.

As illustrated in FIG. 4A, the transformer 62 increases voltage of an AC signal generated by a drive circuit 61 to multiply the amplitude by several tens of times. A rectifier circuit 51, which includes diodes 64 and 65 and capacitors 63 and 66, rectifies and smoothes the increased AC signal. The rectified and smoothed voltage signal is output as DC voltage to an output terminal 53. A comparator 60 controls output voltage from the drive circuit 61 such that the voltage of the output terminal 53 divided by detection resistances 67 and 68 becomes equal to a voltage setting value 55 set by the control unit 54. According to the voltage from the output terminal 53, a current flows via the primary transfer roller 26*a*, the photosensitive drum 22*a* and ground.

Here, the current detection circuit 47*a* is inserted into a secondary circuit 500 of the transformer 62 and a ground point 57. Since impedance at an input terminal of an operational amplifier 70 is high, little current flows. Accordingly, almost all of DC current flowing to the output terminal 53 from the ground point 57 via the secondary circuit 500 of the transformer 62 flows into a resistance 71. An inverted input terminal of the operational amplifier 70 is connected to an output terminal via the resistance 71 (negatively fed back) and thus virtually grounded to a reference voltage 73 connected to a non-inverted input terminal. Accordingly, a detection voltage 56 proportional to an amount of current flowing through the output terminal 53 appears at the output terminal of the operational amplifier 70. In other words, if the current flowing through the output terminal 53 varies, the current flowing through the resistance 71 varies in a manner where the detection voltage 56 at the output terminal of the operational amplifier 70 varies instead of the inverted input terminal of the operational amplifier 70. Note that the capacitor 72 is for stabilizing the inverted input terminal of the operational amplifier 70.

The current characteristics of the primary transfer rollers 26*a* to 26*d* vary according to factors, such as degradation of various elements and environment including temperature in the apparatus. Accordingly, at a timing before the toner image reaches the primary transfer roller 26*a* immediate after printing, the control unit 54 measures a detection value 56 (detection voltage 56) of the current detection circuit 47*a* at an A/D input port, and sets the voltage setting value 55 such that the detection value 56 (detection voltage) becomes a predetermined value. The transfer performance of the toner image can thus be maintained constant even if ambient temperature and humidity vary.

[Description of Misregistration Correction Control]

Hereinafter, the above-mentioned image forming apparatus forms a mark for detecting misregistration on the intermediate transfer belt 30 and at least reduces the amount of misregistration to become smaller. After the misregistration condition is eliminated (at least reduced), time for the electrostatic latent image 80 reaching the position of primary transfer roller 26*a* is measured by detecting variation of the primary transfer current. This time is set as a reference value of the misregistration correction control.

In misregistration correction control executed when the temperature in the apparatus is changed due to continuous printing, the change of the primary transfer current is detected again. Thus, the time of the electrostatic latent image 80 reaching primary transfer roller 26*a* is measured. The amount of misregistration is reflected in the measured change of reaching time as it is. Accordingly, in printing, the timing of emission of the laser light beam 21*a* from the scanner unit 20*a* is adjusted to eliminate the amount, thereby correcting the misregistration. The description will hereinafter be made in detail. Note that control of image forming conditions related to misregistration correction is not limited to control of timing of the light emission. For instance, control of speed of the photosensitive drum, which will be described in Embodiment 2 later, and mechanical adjustment of the position of reflecting mirrors included in the scanner units 20*a* to 20*d* may be adopted.

[Flowchart of Reference Value Obtaining Processing]

Figure 5:
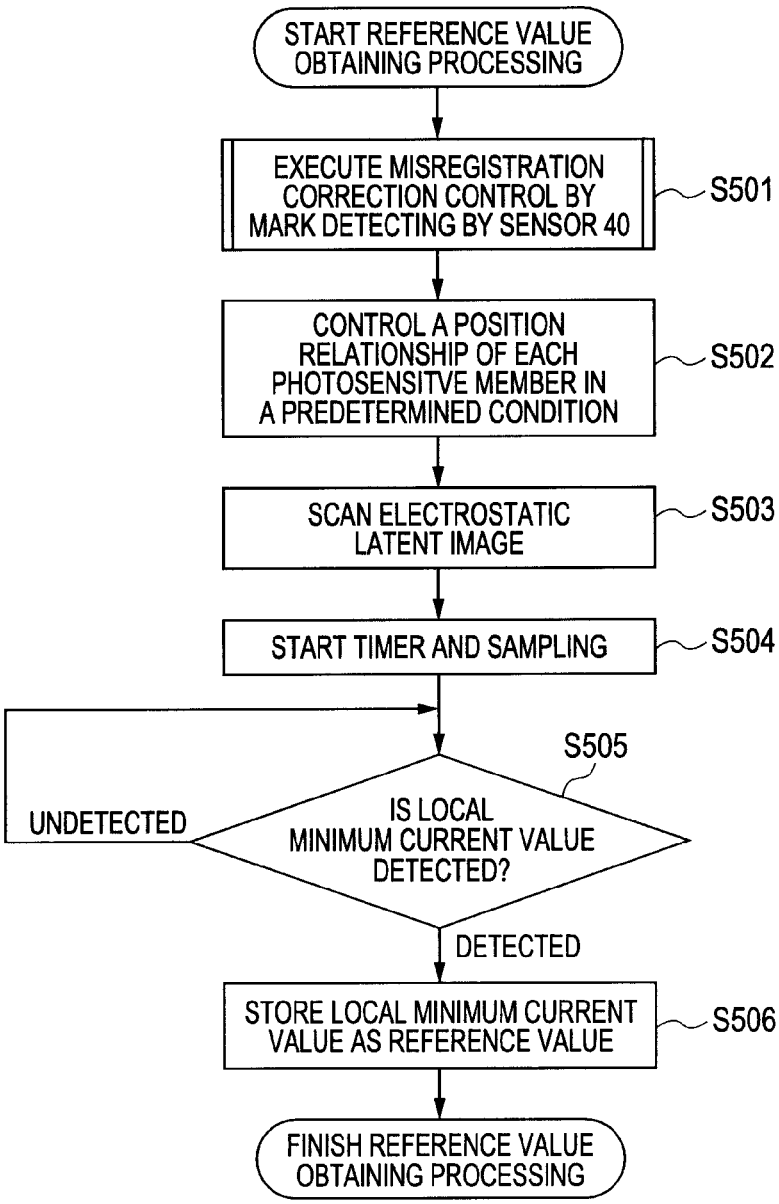
FIG. 5 is a flowchart illustrating reference value obtaining processing.

A flowchart of FIG. 5 illustrates reference value obtaining processing in the misregistration correction control. First, the flowchart of FIG. 5 is subsequently executed after the misregistration correction control (hereinafter, referred to as normal misregistration correction control) due to detection of a toner mark (FIG. 6) of the misregistration detection sensor 40. Instead, the flowchart of FIG. 5 may be executed in response only to the normal misregistration correction control at a specific timing when parts such as the photosensitive drum 22 and the developing sleeve 24 are replaced and the normal misregistration correction control is executed. The flowchart of FIG. 5 is independently executed for each color. The misregistration detection sensor 40 includes a light emitting element such as an LED. The misregistration detection sensor 40 includes a configuration that emits with light the misregistration toner image for detection formed on the belt by the light emitting element and detects variation of amount of reflected light as a position of the toner image (detection timing). This is a technique well-known according to a lot of documents. The detailed description of the technique is omitted.

Figure 6:
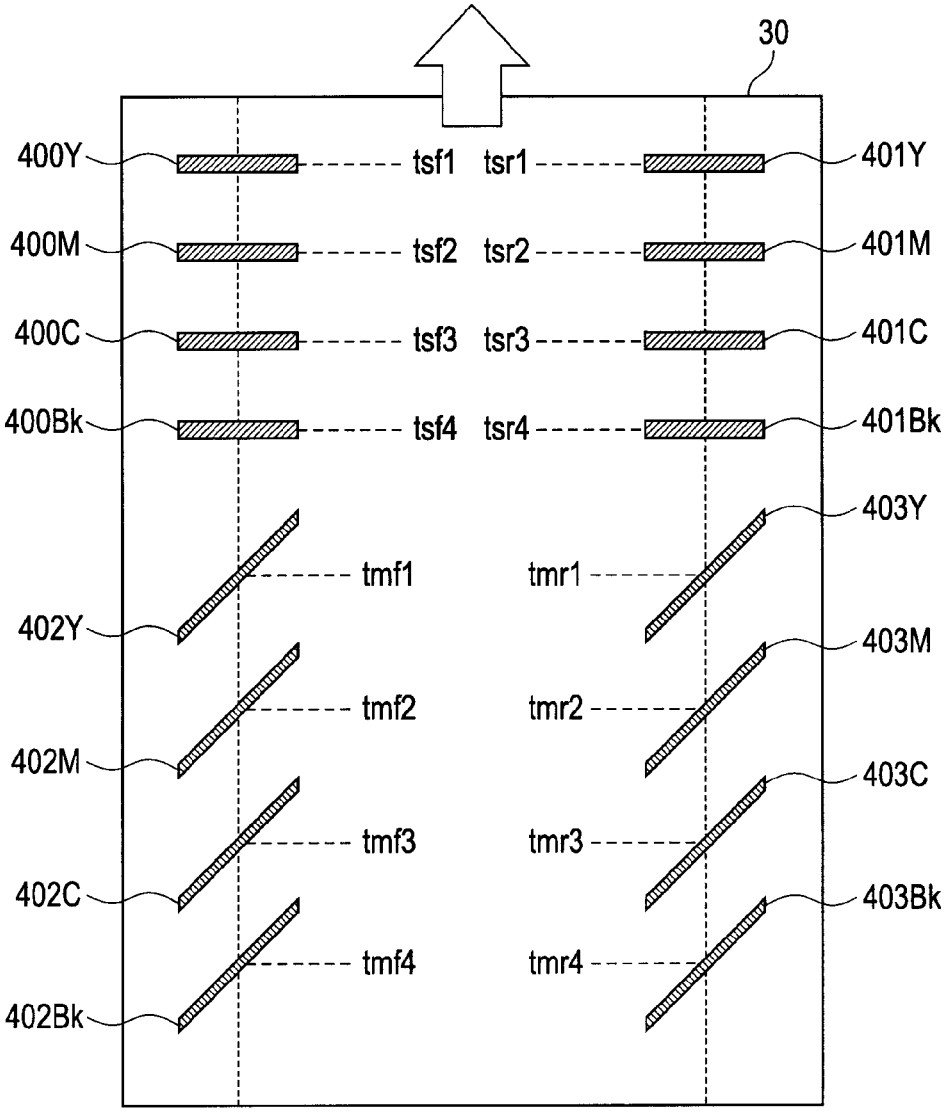
FIG. 6 is a diagram illustrating an example of a state of formation of a mark for detecting misregistration (for misregistration correction) formed on an intermediate transfer belt.

FIG. 5 will be described. In step S501, the control unit 54 causes the image forming unit to form a toner mark for detecting misregistration on the intermediate transfer belt 30. This toner mark for detecting misregistration is a toner image used for misregistration correction. Accordingly, the toner mark may be referred to as a toner image for misregistration correction. FIG. 6 illustrates a state of forming the toner mark for detecting misregistration. Due to the processing in the step S501, a condition where the amount of misregistration is at least reduced can be regarded as a basic in control by the electrostatic latent image for subsequent misregistration correction.

FIG. 6 illustrates patterns 400 and 401 for detecting the amount of misregistration in the sheet conveying direction (sub-scanning direction). Patterns 402 and 403 are for detecting the amount of misregistration in a main scanning direction perpendicular to a sheet conveying direction. In this example, the patterns are inclined at an angle of 45 degrees. Detection timings tsf1 to 4, tmf1 to 4, tsr1 to 4 and tmr1 to 4 are timings for detecting the respective patterns. An arrow illustrates a moving direction of the intermediate transfer belt 30.

The moving speed of the intermediate transfer belt 30 is v mm/s. Y is a reference color. Theoretical distances between respective colors of patterns (400 and 401) for the sheet conveying direction and a Y pattern are dsM mm, dsC mm and dsBk mm. Y is concerned as the reference color; the amounts δes of misregistration for the respective colors in the conveying direction are represented in following Equations 1 to 3.

$$\delta esM = v \times \{(tsf2 - tsf1) + (tsr2 - tsr1)\}/2 - dsM \quad \text{Equation 1}$$

$$\delta esC = v \times \{(tsf3 - tsf1) + (tsr3 - tsr1)\}/2 - dsC \quad \text{Equation 2}$$

$$\delta esBk = v \times \{(tsf4 - tsf1) + (tsr4 - tsr1)\}/2 - dsBk \quad \text{Equation 3}$$

The amounts of left and right positional deviations δemf and δemr for the colors in the main scanning direction are as follows.

$$dmfY = v \times (tmf1 - tsf1) \quad \text{Equation 4}$$

$$dmfM = v \times (tmf2 - tsf2) \quad \text{Equation 5}$$

$$dmfC = v \times (tmf3 - tsf3) \quad \text{Equation 6}$$

$$dmfBk = v \times (tmf4 - tsf4) \quad \text{Equation 7}$$

and $$dmrY = v \times (tmr1 - tsr1) \quad \text{Equation 8}$$

$$dmrM = v \times (tmr2 - tsr2) \quad \text{Equation 9}$$

$$dmrC = v \times (tmr3 - tsr3) \quad \text{Equation 10}$$

$$dmrBk = v \times (tmr4 - tsr4) \quad \text{Equation 11}$$

accordingly, $$\delta emfM = dmfM - dmfY \quad \text{Equation 12}$$

$$\delta emfC = dmfC - dmfY \quad \text{Equation 13}$$

$$\delta emfBk = dmfBk - dmfY \quad \text{Equation 14}$$

and $$\delta emrM = dmrM - dmrY \quad \text{Equation 15}$$

$$\delta emrC = dmrC - dmrY \quad \text{Equation 16}$$

$$\delta emrBk = dmrBk - dmrY \quad \text{Equation 17}$$

The direction of deviation can be determined according to whether the calculation result is positive or negative. The position of starting writing is corrected according to δemf. The main scanning width (main scanning magnification) can be corrected according to δemr−δemf. If in a case of including an error in the main scanning width (main scanning magnification), the position of starting writing is calculated not only with δemf but also with an amount of variation of an image frequency (imaging clock) having varied according to the main scanning width correction.

The control unit 54 changes the timing of emitting the laser light beam from the scanner unit 20*a* as an image forming condition so as to cancel the calculated amount of misregistration. For instance, if the amount of misregistration in the sub-scanning direction is an amount of −4 lines, the control unit 54 instructs the video controller 200 to advance the timing of emitting laser light by +4 lines.

In FIG. 6, it is described that the toner mark for detecting misregistration is formed on the intermediate transfer belt 30. However, it is not limited to this configuration as to where to form the toner mark for detecting misregistration and to detect the mark by the optical sensor (misregistration detection sensor 40). For instance, the toner mark for detecting misregistration may be formed on the photosensitive drum 22; a detection result of the misregistration detection sensor (optical sensor) arranged to be capable of detecting the mark may be adopted. Instead, the toner mark for detecting misregistration may be formed on a sheet (recording material); a detection result of the misregistration detection sensor (optical sensor) arranged to be capable of detecting the mark may be adopted. It is assumed to form the toner mark for detecting misregistration on various media for transformation and toner-bearing media.

The description is returned to that on the flowchart of FIG. 5. In step S502, the control unit 54 adjusts rotational phase relationship (rotational position relationship) between the photosensitive drums 22*a* to 22*d* to a predetermined condition so as to suppress an effect in the case with variation of rotational speeds (circumferential speed) of the photosensitive drums 22*a* to 22*d*. More specifically, under control of the control unit 54, with respect to the phase of the photosensitive drum for the reference color, the phases of the photosensitive drums for the other colors are adjusted. In a case of providing a photosensitive drum driving gear on a shaft of the photosensitive drum, the phase relationship of the driving gear is adjusted from a substantial point of view. Accordingly, the rotational speed of the photosensitive drum when the toner image developed on each photosensitive drum is transferred onto the intermediate transfer belt 30 becomes one of substantially identical tendency and analogous tendency of speed variation. More specifically, the control unit 54 issues an speed control instruction to the motor for driving a photosensitive drum, which is not illustrated, so as to adjust the rotational position relationship between the photosensitive drums 22*a* to 22*d* to a predetermined condition. In a case where the variation of the rotational speed of the photosensitive drum is within an ignorable extent, the processing in the step S502 may be omitted.

In step S503, the control unit 54 causes the scanner units 20*a* to 20*d* to emit laser light beams onto the rotating photosensitive drums at a predetermined rotational phase, forming the electrostatic latent images for misregistration correction (first electrostatic latent images for misregistration correction) on the photosensitive drums.

Figure 7:
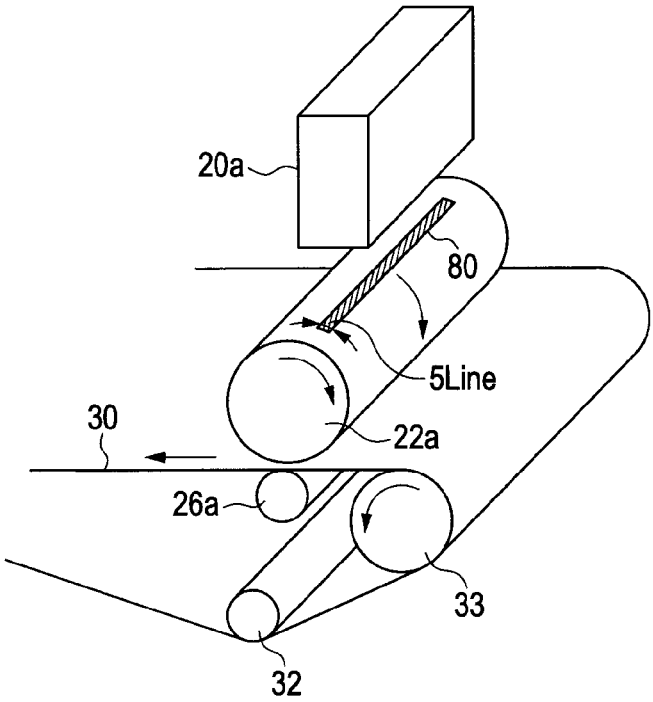
FIG. 7 is a diagram illustrating a state of formation of an electrostatic latent image for detecting misregistration (for misregistration correction) on a photosensitive drum.

FIG. 7 illustrates a condition where the electrostatic latent image, which may also referred to as electrostatic latent image for positional deviation correction, is formed on the photosensitive drum using the photosensitive drum 22*a* for yellow. In this figure, the electrostatic latent image 80 is drawn in an image region width in the scanning direction as wide as possible. The width thereof is about five lines in the conveying direction. The width in the main scanning direction may be formed to be a width at least half the maximum width for the sake of obtaining a satisfactory detection result. Further, the width of the electrostatic latent image 80 may be extended to a region of width exceeding the region of the sheet outside of the image region (print image region on the sheet) and capable of forming the electrostatic latent image. At this time, for instance, the developing sleeve 24*a* is separated from the photosensitive drum 22*a* (separation). This allows the electrostatic latent image 80 to be conveyed to the position of the primary transfer roller 26*a* without adhesion of toner. Under an instruction of the control unit 54, voltages output from development bias high-voltage power supply circuits (development high-voltage power supply circuits) 44*a* to 44*d* may be set to zero; instead, a bias voltage with a polarity inverted from a normal one may be applied. This prevents toner adhesion. In the rotational direction of the photosensitive drum, it is thus required to separate the developing sleeve 24*a* arranged upstream to the primary transfer roller 26*a* or to operate this sleeve so as to at least reduce the effect on the photosensitive drum to be smaller than that when a normal toner image is formed by the image forming unit.

The control unit 54 starts timers provided for the respective YMCK at a time identical or substantially identical to the time of the processing of step S503 (step S504). The control unit 54 also starts sampling of the detection value of the current detection circuit 47*a*. The sampling frequency at this time is, for instance, 10 kHz.

Figure 8:
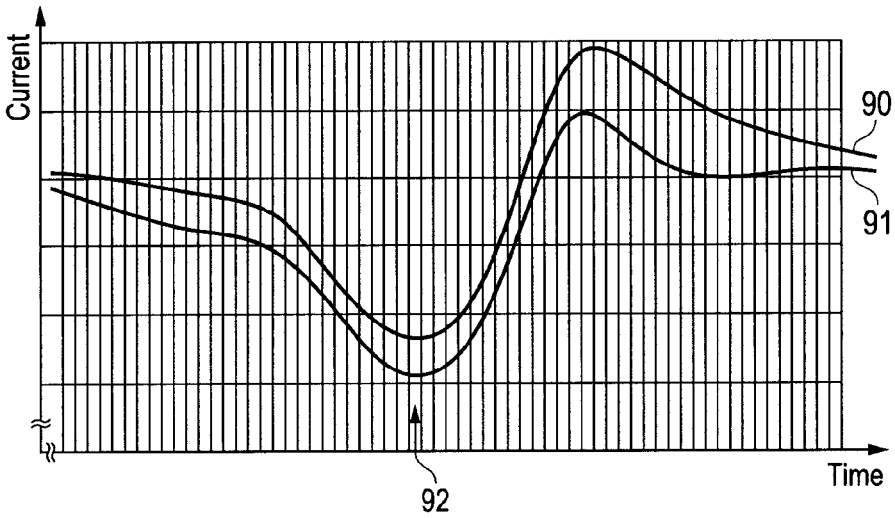
FIG. 8 is a diagram illustrating an example of a result of detection of surface potential information of the photosensitive drum.

In step S505, the control unit 54 measures time (timer value) on which the detection value of the primary transfer current becomes a local minimum by detecting the electrostatic latent image 80 based on a data obtained by sampling in step S504. According to this measurement, passing of the electrostatic latent image 80 formed on the photosensitive drum to the position facing to the primary transfer roller. FIG. 8 illustrates an example of a detection result.

FIG. 8 illustrates detection of an output value on surface potential of the photosensitive member (photosensitive drum 22*a*) from current detection circuit 47*a* when the electrostatic latent image 80 reaches the primary transfer roller 26*a* as the process unit. The description will be made in detail in aftermentioned FIGS. 9A and 9B. Information of FIG. 8 is according to the surface potential of the photosensitive drum 22*a*. Accordingly, this information can be referred to as information of the surface potential of the photosensitive drum 22*a* in this respect. In FIG. 8, the axis of ordinates illustrates the detected current; the axis of abscissas illustrates time. One scale of the axis of abscissas illustrates a time in which the laser scanner scans one line. Current waveforms 90 and 91 are detected at different timings. Any of the current waveforms 90 and 91 illustrates characteristics in which the electrostatic latent image 80 reaches the primary transfer roller 26*a* and thereby a local minimum is reached on a time 92 and then the current returns.

Figure 9A:
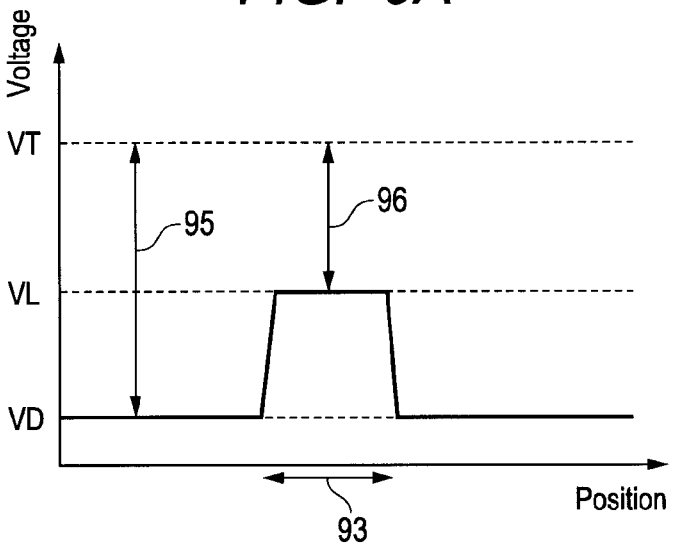
FIG. 9A is a schematic diagram illustrating a surface potential of the photosensitive drum in a case where toner is not adhered on the electrostatic latent image.
Figure 9B:
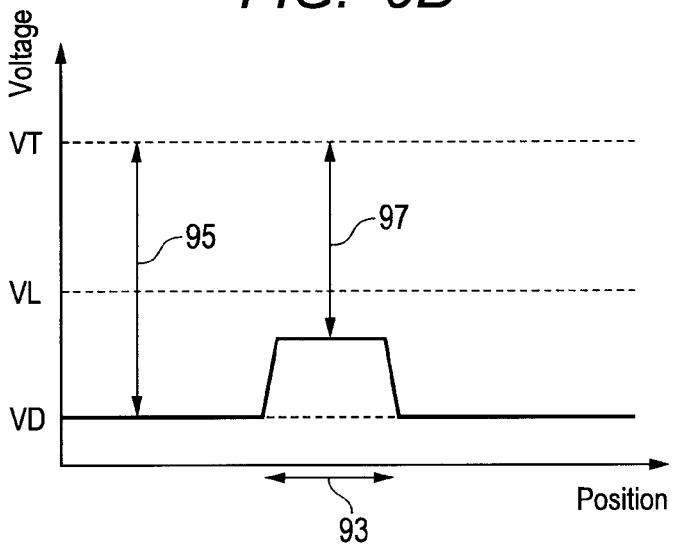
FIG. 9B is a schematic diagram illustrating a surface potential of the photosensitive drum in a case where toner is adhered on the electrostatic latent image.

Here, a reason for reduction of the detected current value will be described. FIGS. 9A and 9B are schematic diagrams illustrating the surface potential of the photosensitive drum 22*a* in the case where toner is not adhered on the electrostatic latent image and the case where toner is adhered thereon, respectively. The axis of abscissas illustrates the surface position of the photosensitive drum 22*a* in the conveying direction. A region 93 illustrates a position where the electrostatic latent image 80 is formed. The axis of ordinates illustrates potential. The dark potential VD (e.g. −700 V) of the photosensitive drum 22*a* and the light potential VL (e.g. 100 V) are illustrated. The transfer bias potential VT (e.g. +1000 V) of the primary transfer roller 26*a* is also illustrated.

In the region 93 of the electrostatic latent image 80, a potential difference 96 between the primary transfer roller 26*a* and the photosensitive drum 22*a* becomes smaller than a potential difference 95 in another region. Accordingly, when the electrostatic latent image 80 reaches the primary transfer roller 26*a*, the value of current flowing in the primary transfer roller 26*a* is reduced. This is the reason for the above-mentioned detection of the local minimum value in FIG. 8. The surface potential of the photosensitive drum 22*a* is reflected in the thus detected current value. In FIGS. 9A and 9B, the description has been made using the example of the difference between the surface potential of the photosensitive drum and the output voltage from the primary transfer roller 26*a*. As to variation of amounts of current, analogous description can be made between the surface potential of the photosensitive drum and one of the charged potential and the development voltage.

The description will be returned to the flowchart of FIG. 5. Finally, in step S506, the control unit 54 stores the time (timer value) measured in step S505 as a reference value in the EEPROM 324. The information stored here represents a reference condition to be a target when the misregistration correction control is executed. In the misregistration correction control, the control unit 54 executes control so as to cancel the deviation from the reference condition, in other words, to return the condition to the reference condition.

The timer value required in step S506 adopts the timing of forming the electrostatic latent image by the scanner units 20*a* to 20*d* in step S503 as a basic (reference). The adoption of the timing of forming the electrostatic latent image as the basic is that it is not limited to the timing of forming the electrostatic latent image itself. Instead, for instance, a timing related to the timing of forming the electrostatic latent image, such as one second before formation of the electrostatic latent image, may be adopted. EEPROM 324 may be a RAM with a backup battery. The information to be stored may be something capable of identifying time. For instance, the information may be one of information of the number of seconds itself and a clock count value.

[Detailed Description of Step S505]

Here, a reason for measuring the time where detected waveforms (current waveforms) 90 and 91 become local minimums will be described. This is because the timing on which the electrostatic latent image 80 reaches the primary transfer roller 26*a* can accurately be measured even in a case where the absolute value of the measured current is different as with a case of the detected waveforms (current waveforms) 90 and 91. The reason for adopting the shape, such as the electrostatic latent image illustrated in FIG. 7, as the pattern for detection (electrostatic latent image for misregistration correction) is for increasing variation in current value by adopting a pattern wide in the main scanning direction. Further, the width of a several lines in the conveying direction (sub-scanning direction) of the photosensitive drum 22 is adopted. Accordingly, the point of the local minimum sharply appears while the large variation of the current value is maintained. Thus, the optimal shape of the electrostatic latent image 80 is different according to the configuration of the apparatus. The shape is not limited to the shape including a width of five lines in the conveying direction, which is adopted in this embodiment.

Figure 10:
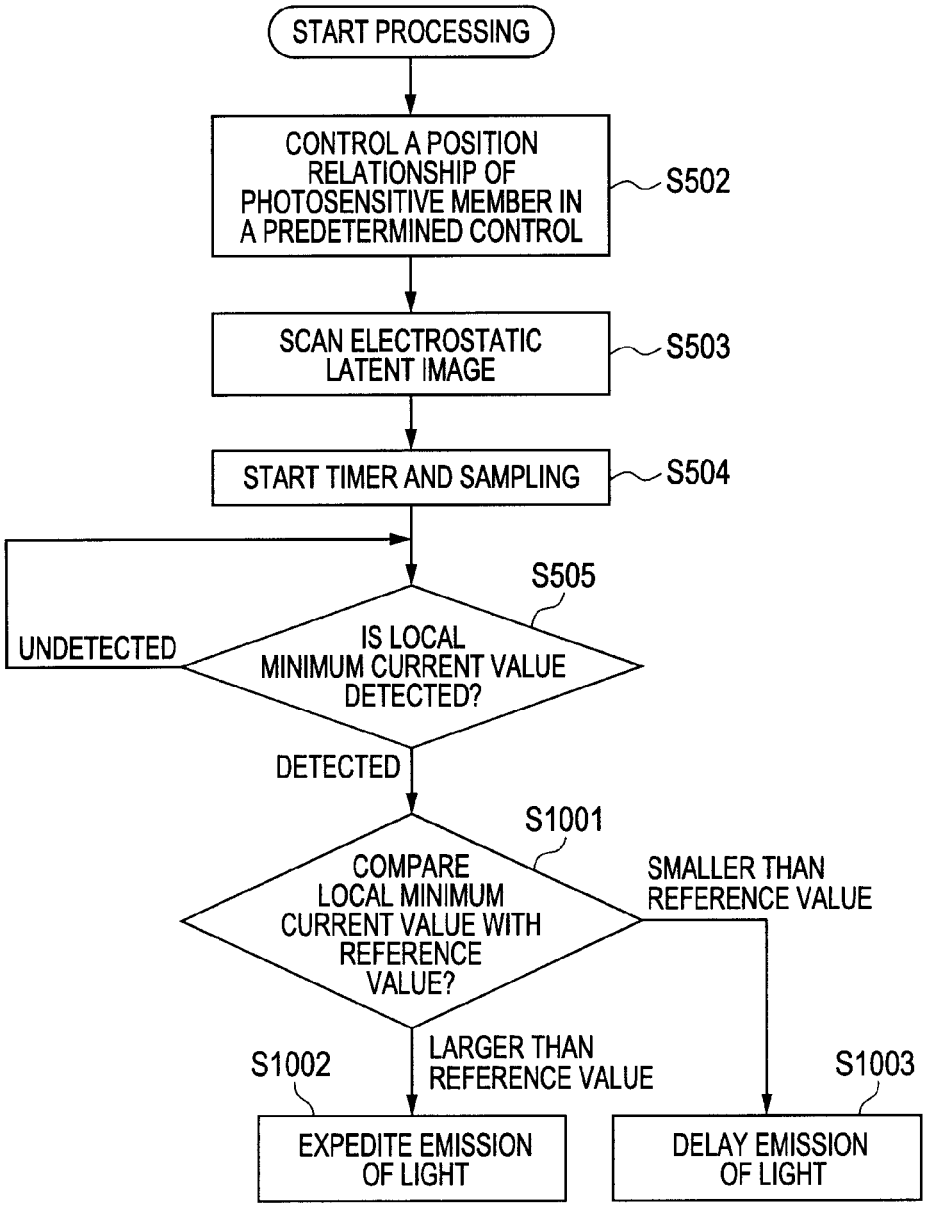
FIG. 10 is a flowchart of misregistration correction control.

The detection result illustrated in FIG. 8 may be adopted. However, for instance, the width in the conveying direction of the electrostatic latent image 80 may be 20 lines, which is wider than five lines, a region flat to the detection result may be formed and the midpoint thereof may be detected. That is, it is suffice that, when an after-mentioned flowchart of FIG. 10 is executed, a position satisfying the specific condition (characteristic position) detected in the flowchart of FIG. 5 can be detected from the detection result. With such a mode, not only the above-mentioned position of the local minimum but also various characteristic positions of the detection results may be applied to the determination target in steps S505 of FIGS. 5 and 10. This application also holds for after-mentioned FIGS. 12 and 13.

In the above description, the configuration has been described that, when the misregistration according to the flowchart of FIG. 5 is detected, the developing sleeve 24*a* is separated from the photosensitive drum 22*a* and detection is made without applying toner onto the electrostatic latent image 80. However, the configuration is not limited thereto. Even in a case of application of toner, the misregistration can be detected.

FIG. 9B is a schematic diagram illustrating a potential difference between the photosensitive drum 22*a* and the primary transfer roller 26*a* in the case where toner is adhered on the electrostatic latent image 80. The elements identical to those in FIG. 9A are assigned with the same symbols, and the description thereof is omitted. In the case where toner is adhered on the electrostatic latent image 80, a potential difference 97 between the primary transfer roller 26*a* and the photosensitive drum 22*a* in the region 93 in the electrostatic latent image 80 is larger than the potential difference 96 in the case without toner. The difference from the potential difference 95 in the other regions becomes smaller. However, variation can sufficiently be detected. Here, after detection of the misregistration, necessity to clean the toner on the photosensitive drum 22 and the intermediate transfer belt 30 arises. However, if the density thereof is not high, only simple cleaning is required. There is substantially no problem. In comparison with a case where 100% density toner image for detection in misregistration correction is transferred onto the intermediate transfer belt 30 and the toner is cleaned, cleaning can at least be performed with shorter time.

[Flowchart of Misregistration Correction Control]

Next, the misregistration correction control of this embodiment will be described using a flowchart of FIG. 10. The flowchart of FIG. 10 is executed separately for each color. The flowchart of FIG. 10 is executed under a predetermined condition. As described above, the condition includes the case where the temperature in the apparatus has been changed owing to continuous printing, the case where the instruction of the misregistration correction control of FIG. 10 has been input into the control unit 54 by a user's operation and the case where environment in the apparatus has largely been changed. This description also holds for after-mentioned FIGS. 13, 21, 25A, 25B-1, 25B-2 and 27.

First, in steps S502 to S505, the processing identical to that of FIG. 5 is performed. In a case where the shaft of the photosensitive drum 22*a* is decentered, the time required for the above-mentioned electrostatic latent image 80 to reach the primary transfer roller 26*a* is changed accordingly. Also in step S503 of FIG. 10, to detect this change, the electrostatic latent image 80 is formed at the position identical to that in step S503 of FIG. 5. The identical position (phase) here may be strictly identical. Instead, the identical position may be substantially or almost identical, only if within an extent capable of improving accuracy of detecting misregistration in comparison with a case of forming the electrostatic latent image 80 at an arbitrary position. Here, the electrostatic latent images for misregistration correction formed on the photosensitive drums in steps S503 in FIGS. 5 and 10 may be discriminated from each other as first and second electrostatic latent images for misregistration correction, respectively.

The control unit 54 compares the timer value obtained when the local minimum current has been detected in step S1001 with the reference value stored in step S506 of the flowchart of FIG. 5. In step S1002, if the timer value is greater than the reference value, the control unit 54 corrects the timing of emitting the laser beam as the image forming condition so as to advance the timing of emitting the laser beam during printing. The setting of how much the control unit 54 advances the timing of emitting the laser beam may be adjusted according to how large the measured time is in comparison with the reference value. On the other hand, if the timer value detected in step S1003 is smaller than the reference value, the control unit 54 delays the timing of emitting the laser beam during printing. The setting of how much the control unit 54 delays the timing of emitting the laser beam may be adjusted according to how small the measured time is in comparison with the reference value. The image forming condition correction processing in steps S1002 and S1003 allows the present misregistration condition to be returned to the misregistration condition (reference condition) as the reference.

It has been described that, in step S1001 in the flowchart of FIG. 10, the control unit 54 compares the timer value obtained when the local minimum current has been detected with the reference value stored in step S506. However, the configuration is not limited thereto. In a viewpoint of maintaining the misregistration condition at a certain timing, steps S502 to step S506 may be performed in a condition where an arbitrary misregistration occurs, and the stored reference value may be adopted as a target of comparison in step S1001. This description also holds for after-mentioned FIGS. 12 and 13.

[Description of Advantageous Effect]

As described above, the control unit 54 executes the flowchart of FIG. 10. Accordingly, the misregistration correction control can be realized even if the toner image for detection (density of 100%) in the misregistration correction control is not transferred from the photosensitive drum to the image carrier (belt). That is, the misregistration correction control can be executed while usability of the image forming apparatus is maintained as much as possible.

A method has also been known that preliminarily measures a tendency of variation of the amount of misregistration with respect to the amount of variation of temperature in the apparatus, estimates and calculates the amount of misregistration based on the measured temperature in the apparatus and executes the misregistration correction control. This method of misregistration correction control has an advantage of negating the need of forming the toner image for detection on the image carrier. The method of misregistration correction control that estimates and calculates the amount of misregistration can suppress consumption of toner. However, in this method, the amount of misregistration actually occurring does not necessarily match with an estimated and calculated result, causing accuracy imperfection. In contrast, the flowchart of FIG. 10 allows the toner consumption to be suppressed while securing a certain accuracy of misregistration correction control.

As to the misregistration correction control using the electrostatic latent image, for instance, a configuration can be considered that transfers the electrostatic latent image for misregistration correction onto the intermediate transfer belt and provides a potential sensor for detecting the image. However, in this case, waiting time occurs until the potential sensor detects the electrostatic latent image transferred onto the intermediate transfer belt. In contrast, the embodiment can reduce the waiting time in comparison thereto and prevent usability from being reduced.

A system that transfers the electrostatic latent image for misregistration correction onto the intermediate transfer belt should hold the potential of the electrostatic latent image for misregistration correction on the intermediate transfer belt until the potential is detected. Accordingly, it is required to adopt material with a high resistance (at least e13 Ωcm) for the belt and increase the time constant τ not to eliminate charges on the belt instantaneously (e.g. in a 0.1 sec). However, the intermediate transfer belt with a large time constant τ has a disadvantage of easily causing image impairment, such as ghosts and discharging marks owing to belt charged-up. In contrast, the embodiment can reduces the time constant τ of the intermediate transfer belt and suppress the image impairment owing to charging-up.

Embodiment 2

Figure 11:
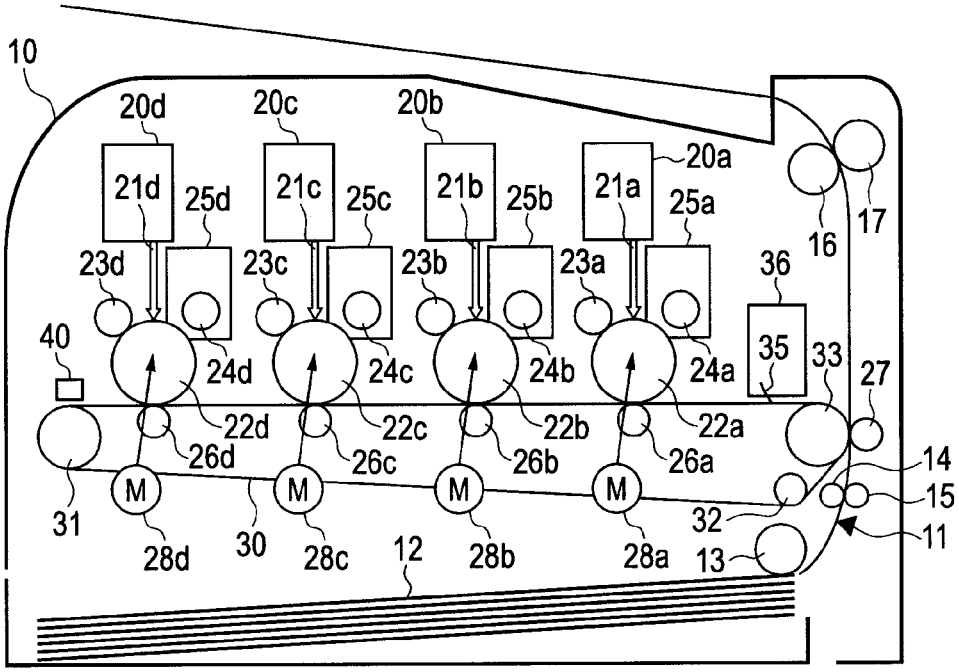
FIG. 11 is a diagram of a configuration of another in-line system (4-drum system) color image forming apparatus.

FIG. 11 is a diagram of a configuration of an image forming apparatus different in configuration from Embodiment 1. The elements identical to those of Embodiment 1 are assigned with the identical symbols. The description thereof is omitted. Differences from the image forming apparatus illustrated in FIG. 1 is that, in the configuration in FIG. 11, the developing sleeves 24*a* to 24*d* are always separated from the photosensitive drums 22*a* to 22*d* and do not act on the photosensitive drum. During printing, the development high-voltage power supply circuits 44*a* to 44*d* apply AC bias voltages to the developing sleeves 24*a* to 24*d*, respectively. This application causes toner to reciprocate between the photosensitive drums 22*a* to 22*d* and the developing sleeves 24*a* to 24*d*, thereby adhering the toner onto the electrostatic latent image. This configuration prevents the toner from being adhered on the electrostatic latent image 80 on the photosensitive drum 22 only by stopping the development high-voltage power supply circuits 44*a* to 44*d*.

In the configuration in FIG. 11, the photosensitive drums 22*a* to 22*d* are driven by independent drive sources 28*a* to 28*d*, respectively, so as to set rotational speeds. Thus, the time elapsing from emission of the laser light beams 21*a* to 21*d* to the electrostatic latent image 80 reaching the primary transfer rollers 26*a* to 26*d* is adjusted constant by changing the respective rotational speeds of the photosensitive drums 22*a* to 22*d* so as to cancel the amount of misregistration of the detected conveying direction. For instance, in a case of increasing the rotational speed of the photosensitive drum, the separation between the electrostatic latent images on the photosensitive drum in the sub-scanning direction is increased. On the contrary, without changing the rotational speed (moving speed) of the intermediate transfer belt 30, the separation between the transfer positions of the toner images in the sub-scanning direction is reduced. Accordingly, expansion and contraction of the image formed on the intermediate transfer belt 30 in the sub-scanning direction substantially presents no problem.

This embodiment assumes a configuration that does not detect the phases of the photosensitive drums 22*a* to 22*d*. However, in a case where the shaft of the photosensitive drum 22*a* is unignorably decentered, the actual measurement result of the time in which the above-mentioned electrostatic latent image 80 reaches the primary transfer roller 26*a* is also changed accordingly. Thus, in this embodiment, plural times of measurement are executed and the misregistration is adjusted based on the average thereof. It is a matter of course that processing of after-mentioned flowcharts can also be applied to the case of using the image forming apparatus illustrated in FIG. 1.

Figure 12:
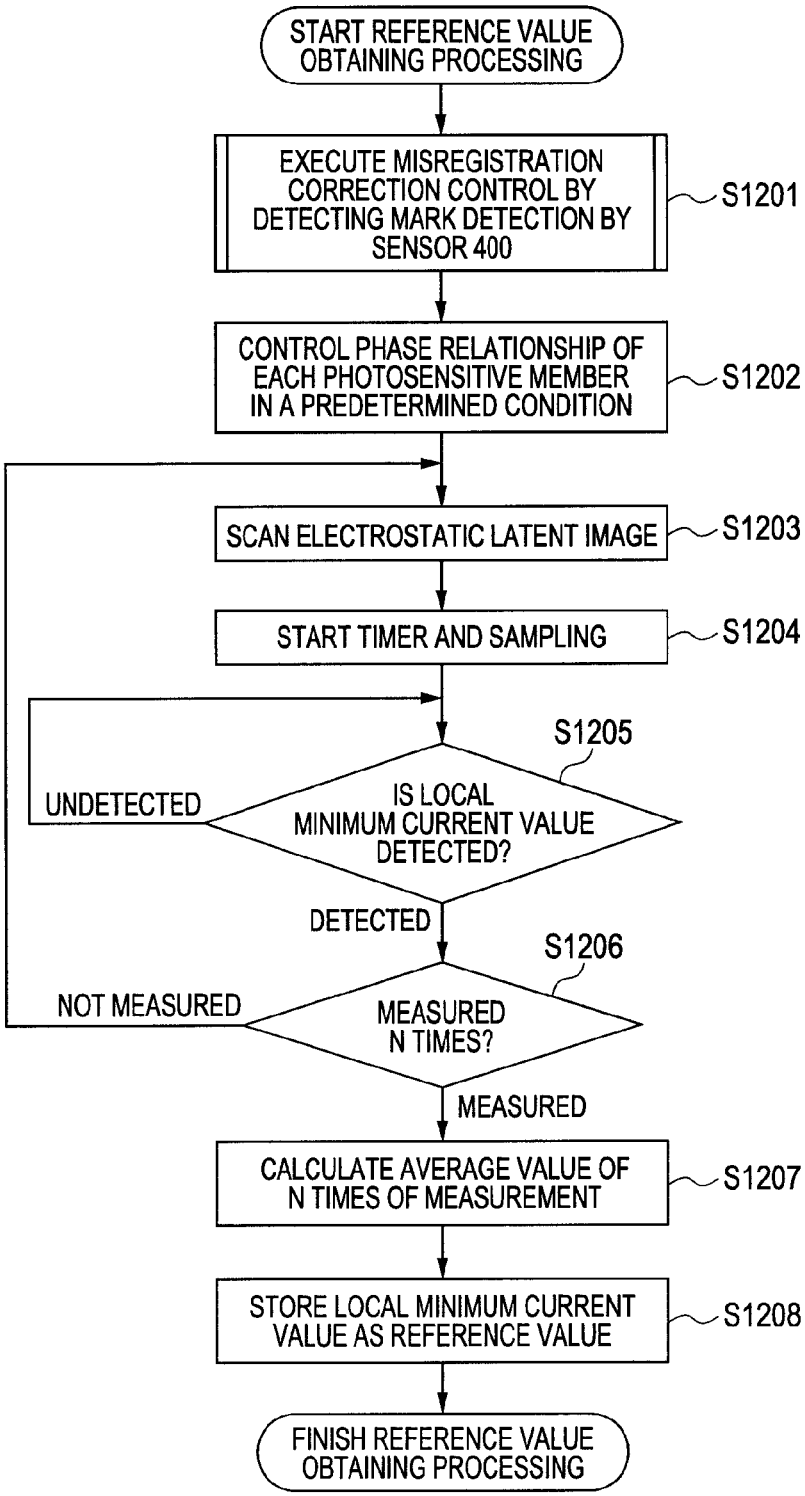
FIG. 12 is a flowchart illustrating another reference value obtaining processing.

FIG. 12 is a flowchart illustrating reference value obtaining processing of Embodiment 2. The flowchart of FIG. 12 is executed separately for each color.

First, in the processing of steps S1201 to S1205 is identical to that of steps S501 to S505 in FIG. 5. The detailed description thereof is omitted.

In step S1206, the control unit 54 executes control of repeating the processing in steps S1203 to S1205, until repeating n times of measurement of the timer value for detecting the local minimum, to cancel the effects owing to the decentering of the photosensitive drums 22*a* to 22*d*. Note that n is an integer at least two. In a case where the electrostatic latent image for misregistration correction for n times is shorter than a revolution of the photosensitive drum, for instance, corresponding to half a revolution of the photosensitive drum, the formation of the electrostatic latent image for misregistration correction at the predetermined rotational phase in step S1203 is particularly effective.

In step S1206, the control unit 54 determines that the n times of measurement have been finished. The control unit 54 then calculates an average value of the timer values (time) acquired by the n times of measurement in step S1207. In step S1208, the control unit 54 stores a data (representative time) of the average value as a representative value (reference value) in the EEPROM 324. Information stored here represents a reference condition to be a target when the misregistration correction control is executed. In the misregistration correction control, the control unit 54 executes control so as to cancel the deviation from the reference condition, in other words, to return the condition to the reference condition. Various calculation methods, such as a simple average and a weighted average, can be assumed as a method of operating an average. In terms of canceling a component of the rotation cycle of the photosensitive drum, such as decentering of the photosensitive drum, the method is not limited to that of calculating the average value. The method may be, for instance, one of a simple summation and a weighted summation only if the operation is for canceling the component of the rotation cycle of the photosensitive drum. The cancellation here does not mean a complete cancellation. The cancellation here at least suppresses the effect due to the component of the rotation cycle of the photosensitive drum. If complete cancellation is possible, it is a matter of course to completely cancel the effect. As described above, in step S1208, the reference value is calculated based on a plurality of acquired data. Accordingly, the accuracy can be improved in comparison with the calculation of the reference value based on a single data.

[Flowchart of Misregistration Correction Control]

Next, a flowchart of FIG. 13 will be described. The processing identical to that of FIG. 12 is assigned with the identical symbols of steps. The flowchart of FIG. 13 is separately executed for each color.

Figure 13:
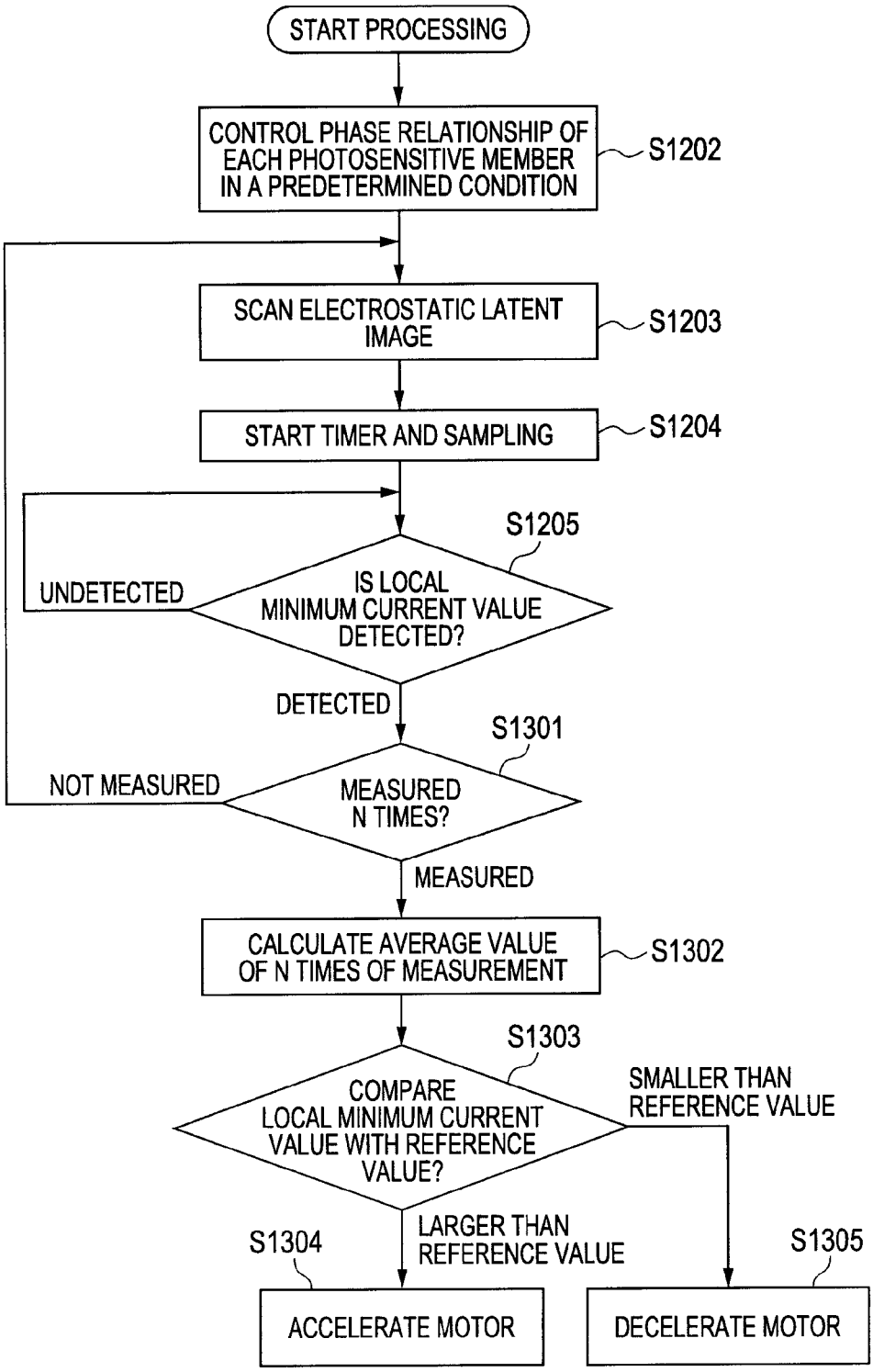
FIG. 13 is a flowchart illustrating another misregistration correction control.

First, the processing in step S1202 to S1205 of FIG. 13 is analogous to corresponding processing in FIG. 12. The control unit 54 repeats the processing in steps S1203 to S1205, until repeating n times of measurement of the timer value for detecting the local minimum, to cancel the effects in the case where the rotational shafts of the photosensitive drums 22*a* to 22*d* are decentered.

In step S1301, the control unit 54 determines that the n times of measurement have been finished. In step S1302, the control unit 54 then calculates an average value of the timer values acquired by the n times of measurement. In step S1303, the control unit 54 reads the reference value stored in step S1208 in FIG. 12 from the memory (EEPROM 324). The control unit 54 compares the calculated average value with the representative value (reference value). Note that, in terms of canceling the component of the rotation cycle of the photosensitive drum, it is not limited to the average value, as described in steps S1207 and S1208.

In a case where the average value is larger than the reference value, the control unit 54 increases the rotational speed of the photosensitive drum as the image forming condition, that is, accelerates the motor, by the amount of time during printing in step S1304. On the other hand, in a case where the average value is smaller than the reference value, the control unit 54 reduces the rotational speed of the photosensitive drum as the image forming condition, that is, decelerate the motor, by the amount of time during printing in step S1305, thereby correcting the misregistration. Thus, the processing in steps S1304 and S1305 allows the present misregistration condition to be returned to the misregistration condition (reference condition) as the reference. In steps S1304 and S1305 in FIG. 13, the processing in one of steps S1002 and S1003 illustrated in the flowchart of FIG. 10 may be executed as the correction of the image forming condition.

[Distribution of Phase of Photosensitive Drum]

In a case of executing the processing of scanning the electrostatic latent image in step S1203 in FIGS. 12 and 13 in a non-image region between pages, the number n of determination in step S1206 in FIG. 12 and step S1301 in FIG. 13 is determined by the dimension of each member of the image forming apparatus. More specifically, the number is determined by the sheet size, the drum circumferential length of the photosensitive drum and the width of the non-image region of the image in the moving direction (rotational direction of the photosensitive drum).

Figure 14A:
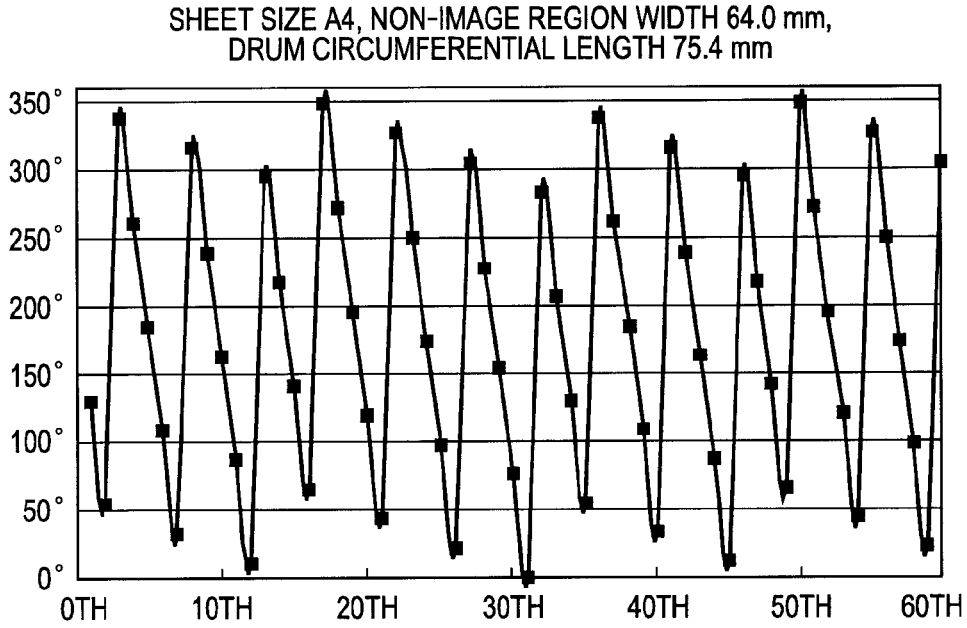
FIGS. 14A and 14B are diagrams each of which illustrates a state of distribution of phases of the photosensitive drum when a data is sampled.
Figure 14B:
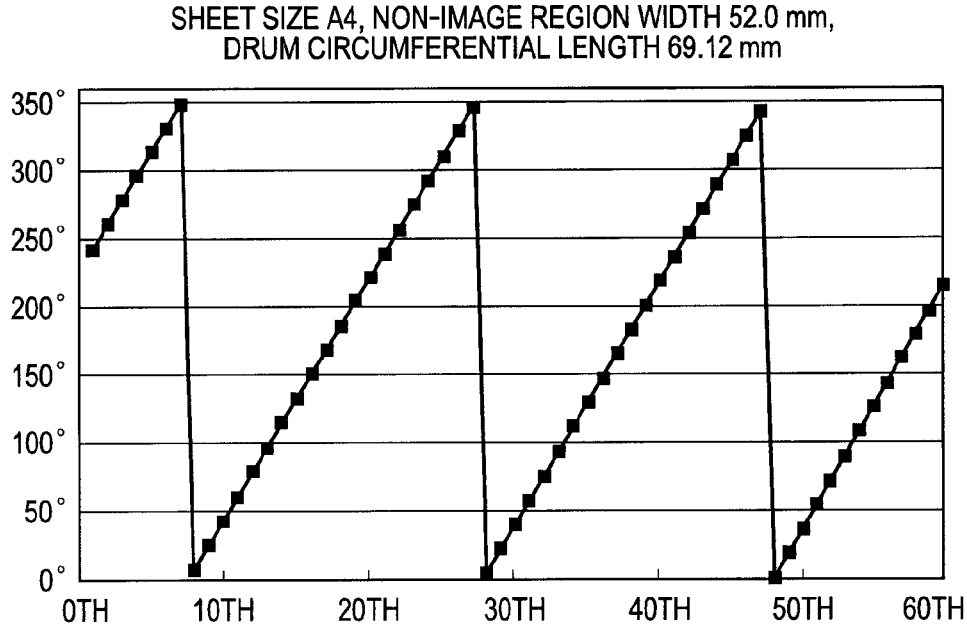

For instance, a graph of FIG. 14A illustrates how the phase of the photosensitive drum at the center of the non-image region is changed in a case where the sheet size is A4 (297 mm), the width of the non-image region of the image in the moving direction is 64.0 mm and the drum circumferential length is 75.4 mm. Further, FIG. 14B illustrates an example where the sheet size, the non-image region width and the drum circumferential length are different values. The description on FIGS. 14A and 14B similarly holds for each color.

The graphs of FIGS. 14A and 14B illustrate what phase of the drum the electrostatic latent image is correspondingly formed, when step S1203 in FIGS. 12 and 13 is executed at the center of each non-image region. Both FIGS. 14A and 14B illustrate the phase condition of the photosensitive drum is averaged/distributed if the plural times of forming the electrostatic latent image in each non-image region in step S1203 in FIGS. 12 and 13.

Figure 15:
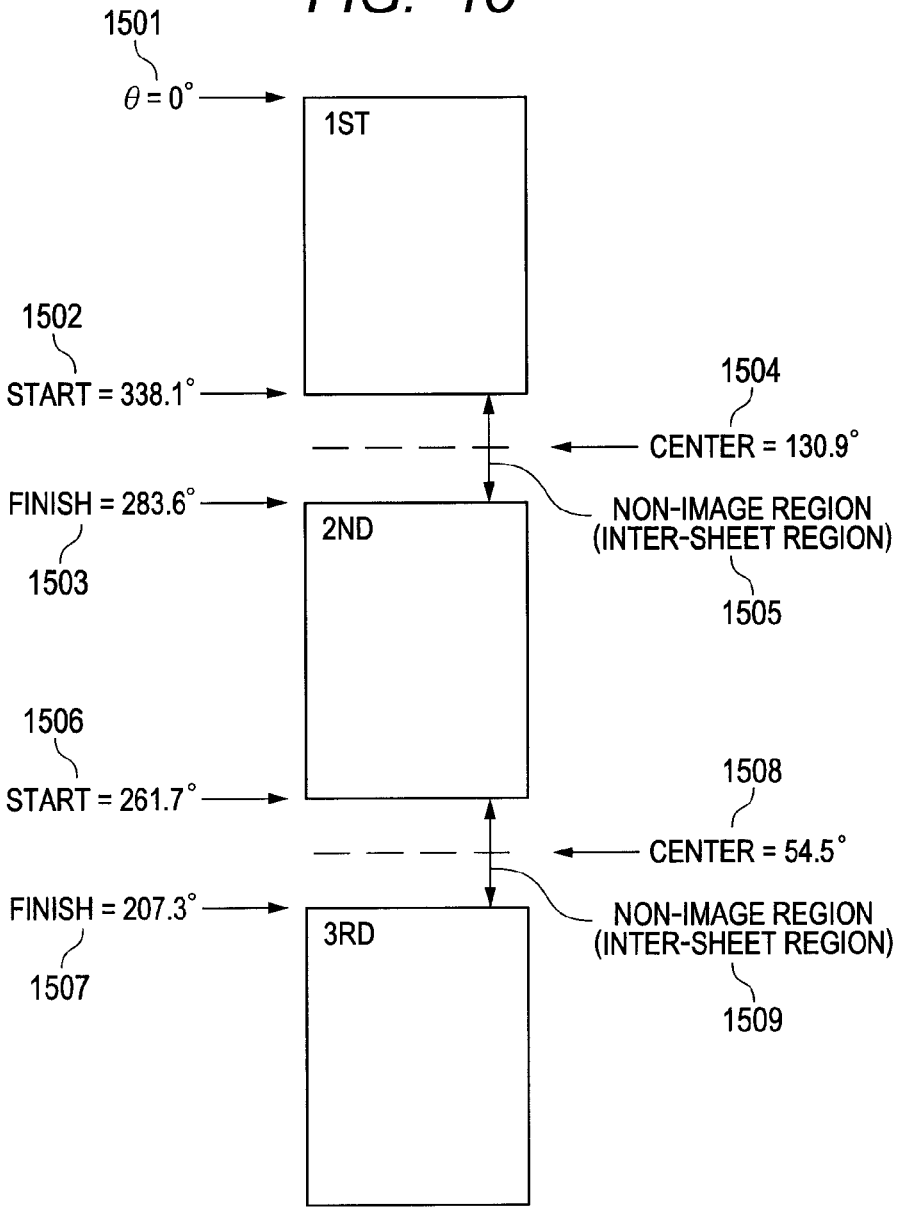
FIG. 15 is a diagram for illustrating a sheet size and a non-image region width.

Here, FIG. 15 illustrates what items the sheet size and the non-image region width indicate. FIG. 15 illustrates a correspondence between the primary transfer position when the toner image is temporarily transferred onto the intermediate transfer belt and the phase of the photosensitive drum when an exposure corresponding to the toner image is executed. The non-image region can be defined as a region on the photosensitive drum, such as a region on the photosensitive drum other than a region (effective image region) capable of forming the electrostatic latent image in the image formation and a region between pages (inter-sheet region). The non-image region can be defined as a time period (time) during which the scanner unit 20 does not execute laser emission for forming an image for each page.

In FIG. 15, respective phases of a start position 1502 (1506) of the non-image region 1505 (1509), a center 1504 (1508) and a finish position 1503 (1507) are determined by the phase of the photosensitive drum corresponding to the position 1501 and the sheet size. As described above, the phase of each photosensitive drum is the phase of the photosensitive drum when the toner image is exposed, provided that the toner image is primarily transferred.

FIG. 15 illustrates the phase 1501 as zero. Another value may be adopted, which presents no problem. That is, even if the phase 1501 is not zero, only timing of appearance is shifted as to how many number of non-image region in which the phase is changed. That is, there is not much difference in terms that the phase of the photosensitive drum is distributed when the electrostatic latent image is formed in step S1203 in FIGS. 12 and 13.

As described above, the control unit 54 executes the flowcharts of FIGS. 12 and 13. Accordingly, in addition to advantageous effects analogous to those of Embodiment 1, highly accurate misregistration correction control using the average value can be realized. Further, misregistration correction control can be executed independent from the phase of the photosensitive drum when the electrostatic latent image for misregistration correction is formed. Accordingly, the start timing of misregistration correction control can further be flexible in terms of timing of starting.

Embodiment 3

In the Embodiment, it has been described that the current value flowing via the primary transfer roller 26*a*, the photosensitive drum 22*a* and the ground is detected according to the output voltage of the output terminal 53 as the output value related to the surface potential of the photosensitive drum 22*a*. However, this is not limited thereto. The charging rollers 23*a* to 23*d* and the developing sleeves 24*a* to 24*d* are provided around the photosensitive drums 22*a* to 22*d*, in addition to the primary transfer rollers 26*a* to 26*d*. Any one of Embodiments 1 and 2 can be applied to the charging rollers 23*a* to 23*d* and the developing sleeves (development rollers) 24*a* to 24*d*. That is, as described above, the output value related to the surface potentials of the photosensitive drums 22*a* to 22*d* when the electrostatic latent images 80 formed on the photosensitive drums 22*a* to 22*d* reach the charging rollers 23*a* to 23*d* and the development sleeves (development rollers) 24*a* to 24*d*, as the process unit, may be detected.

A case of detecting the value of current flowing via the charging roller 23 and the photosensitive drum 22 as the output value related to the surface potential of the photosensitive drum 22 will hereinafter be described as an example. In this case, charged high-voltage power supply circuits 43*a* to 43*d* (FIG. 2B) connected to the respective charging rollers may be provided. Circuits analogous to the high-voltage power supply circuits illustrated in FIG. 4A may be provided for the respective charged high-voltage power supply circuits. The output terminal 53 may be connected to the corresponding charging rollers 23.

Figure 16A:
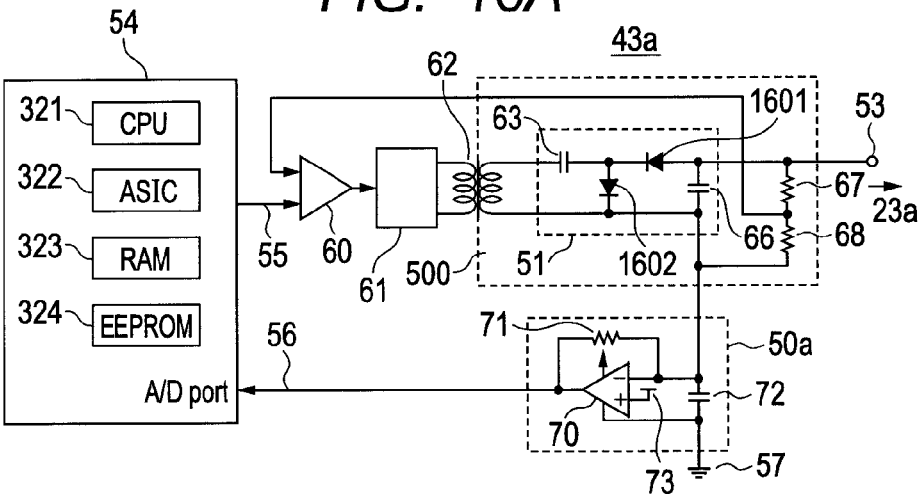
FIG. 16A is a circuit diagram of another high-voltage power supply.

FIG. 16A illustrates the charged high-voltage power supply circuit 43*a* in this case. There is a difference from FIG. 4A in that the output terminal 53 is connected to the charging roller 23*a*. There is another difference in that diodes 1601 and 1602 whose cathode and anode are reversed from those of the diodes 64 and 65 configure the high-voltage power supply circuit. This is because, in the image forming apparatus of this embodiment, the primary transfer bias voltage is positive but the charging bias voltage is negative. Note that the charged high-voltage power supply circuits 43*b* to 43*d* for the other colors have circuit configurations identical to the configuration illustrated in FIG. 16A. Accordingly, the detailed description thereof is omitted, as with the case of the primary transfer high-voltage power supply circuit.

In the flowcharts of FIGS. 5, 10, 12 and 13, the processing is executed by operation of the charged high-voltage power supply circuits 43*a* to 43*d* (not illustrated) instead of the primary transfer high-voltage power supply circuits 46*a* to 46*d*. Note that the target value of current preset to the detection voltage 56 are appropriately set in consideration of characteristics of the charging roller 23 and the relationship with the other members.

When the current detection circuits 50*a* to 50*d* of the charged high-voltage power supply circuits 43*a* to 43*d* are operated and the latent image marks (electrostatic latent images 80) formed on the respective photosensitive drums pass through a nip portion between the photosensitive drum and the intermediate transfer belt 30, the primary transfer rollers 26*a* to 26*d* may be separated from the belt. Instead, without separation, the high voltage outputs of the primary transfer rollers 26*a* to 26*d* may be turned off (zero). This is because the portion of the dark potential VD (e.g. −700 V) on the photosensitive drum is positively charged more than the portion of the light potential VL (e.g. −100 V) due to positive charges supplied from the primary transfer roller. That is, the width of contrast between the dark potential VD and the light potential VL become smaller due to the positive charging described above. In contrast, if this is avoided, the width of contrast between the dark potential VD and the light potential VL can be maintained and the wide range of variation of detection current can be held as it is.

Figure 16B:
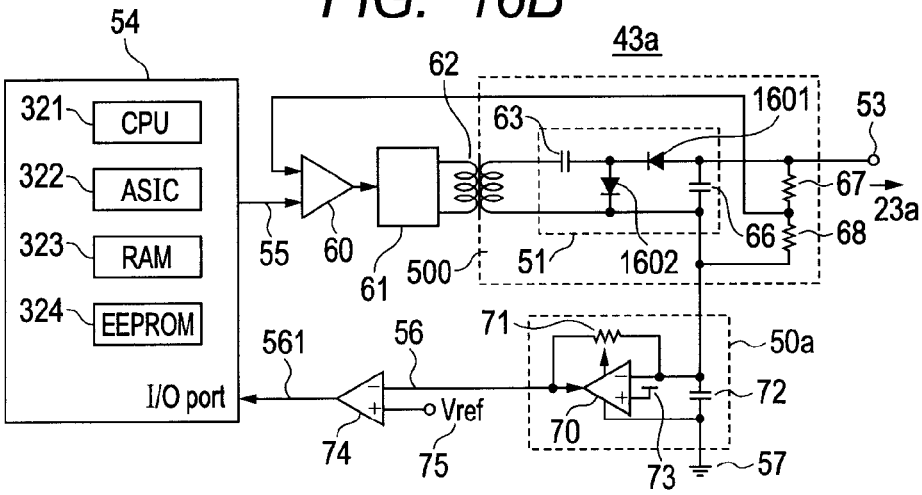
FIG. 16B is a circuit diagram of another high-voltage power supply including another current detection circuit as the third embodiment.

FIG. 16B illustrates another charged high-voltage power supply circuit 43*a*. A difference from FIG. 16A is that the detection voltage 56 representing the amount of detection current is input into an input terminal (inverted input terminal) of a comparator 74. A threshold, Vref 75, is input into the positive input terminal of the comparator 74. In a case where the input voltage of the inverted input terminal falls below the threshold, the output becomes Hi (positive) and a binary voltage value 561 (voltage being Hi) is input into the control unit 54. The threshold Vref 75 is set between a local minimum value of a detection voltage 561 when the electrostatic latent image for misregistration correction passes through a position facing to the process unit and a value of the detection voltage 561 before passing. Rising and falling of the detection voltage 561 are detected by one time of detection of the electrostatic latent image. The control unit 54 regards, for instance, the midpoint between the rising and the falling of the detection voltage 561 as detection points. The control unit 54 may detect only one of the rising and the falling of the detection voltage 561.

In Embodiments 1 and 2, it has been described that, in the case of detecting that the output of the high-voltage power supply circuit satisfies the predetermined condition, the predetermined condition is the detection voltage 56 becoming the local minimum below the certain value. However, the predetermined condition may be anything that represents that the electrostatic latent image 80 formed on the photosensitive drum has passed through the position facing to the process unit. For instance, as illustrated in FIG. 16B, the predetermined condition may be a fact that the detection voltage 561 falls below the threshold. This has already been described in the detailed description on step S505 of Embodiment 1 using FIG. 8. Accordingly, in the above-mentioned and after-mentioned flowcharts, various cases may be assumed as the condition of detecting the electrostatic latent image 80.

In addition to charging and transfer, the development is also considered. As to the development, the flowcharts of FIGS. 5, 10, 12 and 13 may be executed by operating the development high-voltage power supply circuits 44*a* to 44*d* (including the current detection circuit). The target current value in this case is as with the case of the charged high-voltage power supply circuits 43*a* to 43*d*. This value may appropriately be set in consideration of characteristics of the developing sleeve 24 and the relationship with the other members.

In the case of operating the development high-voltage power supply circuits 44*a* to 44*d*, the output voltage may be set higher than VL so as not to adhere toner on the photosensitive drum. For instance, in a case of VL is a negative voltage of −100 V, the outputs from the development high-voltage power supply circuits 44*a* to 44*d* may be set to be negative and a voltage of −50 V whose absolute value is smaller than VL. Instead, circuits analogous to the high-voltage power supply circuit illustrated in FIG. 4A may be added to the development high-voltage power supply circuits 44*a* to 44*d*; in the case where VL is the negative voltage of −100 V, the inverted voltage (inverted bias) may be output.

As described above, according to Embodiment 3, the electrostatic latent image for misregistration correction can be detected using the charging roller 23 and the developing sleeve 24. This allows following advantageous effects to be exerted in addition to advantageous effects analogous to those of Embodiments 1 and 2. That is, in the case of using the primary transfer roller 26, the belt is interposed between the primary transfer roller 26 and the photosensitive drum 22. In contrast, in the case of using the charging roller 23 and the developing sleeve, detection on the surface potential of the photosensitive drum can be made under situations without such an interposition.

Embodiment 4

Figure 17A:
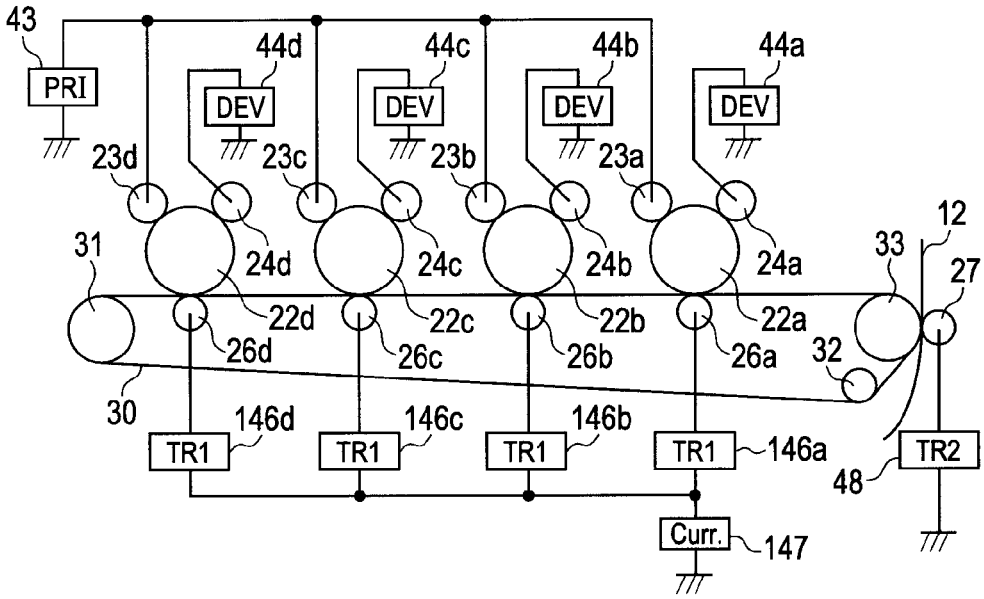
FIGS. 17A and 17B are diagrams of configurations of high-voltage power supply device.
Figure 17B:
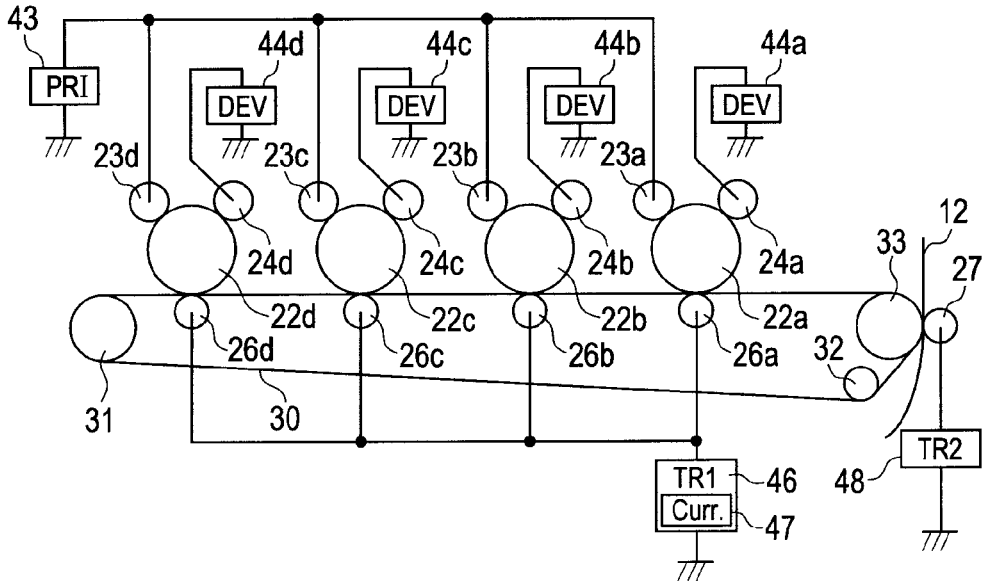

The high-voltage power supply circuits of each of the above Embodiments 1 to 3 is provided with the current detection circuit 47 separately for each process unit. However, the configuration is not limited to this mode. FIGS. 17A and 17B illustrate another example of the high-voltage power supply device. A configuration illustrated in FIG. 17A includes primary transfer high-voltage power supply circuits 146*a* to 146*d* provided separately for the primary transfer rollers 26*a* to 26*d* for the respective colors and a current detection circuit 147 common to the primary transfer rollers 26*a* to 26*d* for the respective colors. In comparison to FIG. 17A, in FIG. 17B, a primary transfer high-voltage power supply circuit 46 is commonly provided to the plurality of primary transfer rollers 26*a* to 26*d*. In both FIGS. 17A and 17B, the elements identical to those of FIGS. 2A and 2B are assigned with the identical symbols. The detailed description thereof is omitted.

[Circuit Diagram of High-Voltage Power Supply]

Figure 18:
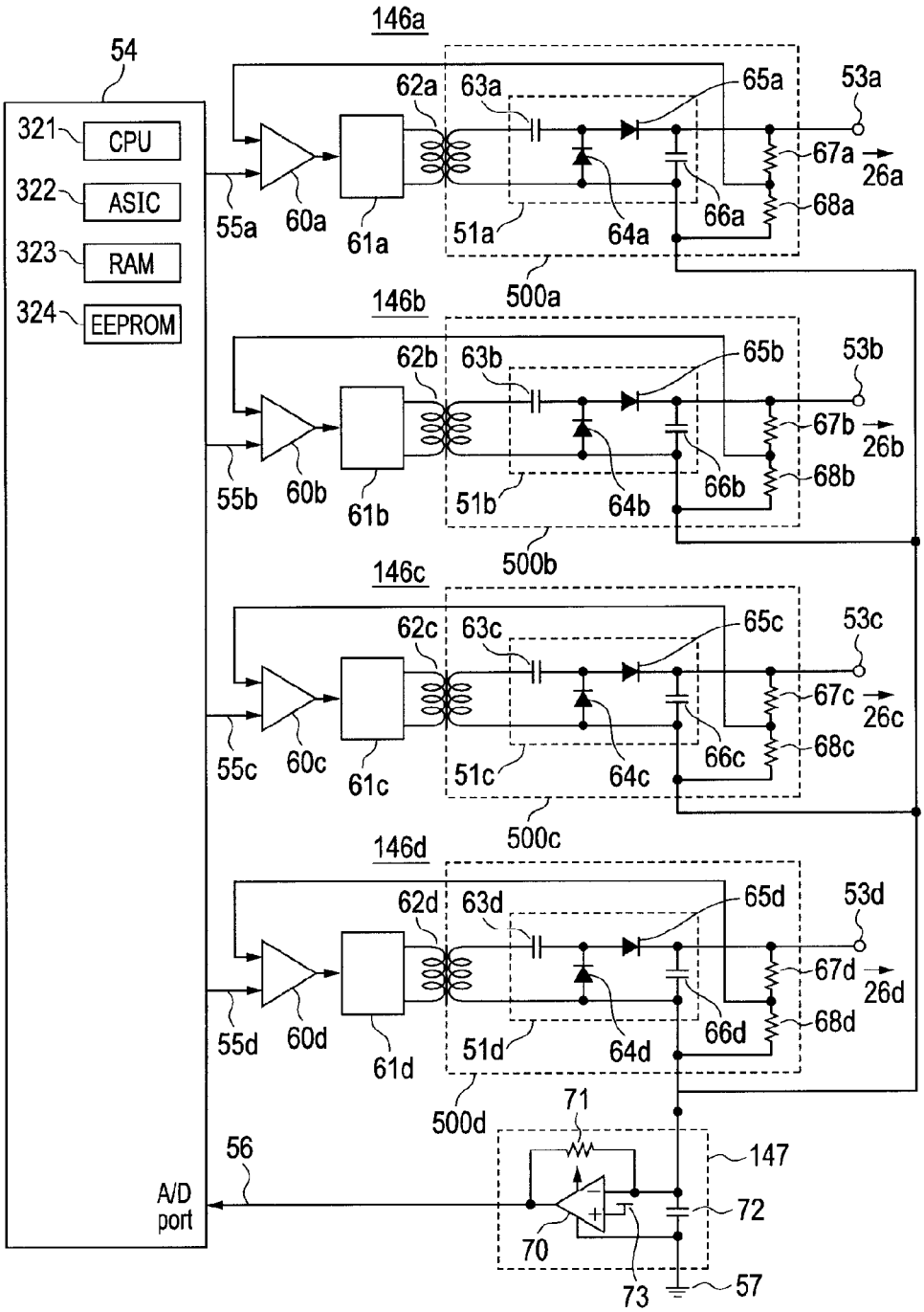
FIG. 18 is a circuit diagram of a high-voltage power supply device.

Circuit configurations of the primary transfer high-voltage power supply circuits 146*a* to 146*d* and the current detection circuit 147 in FIG. 17A will be described using FIG. 18. The elements identical to those in FIG. 4A are assigned with the identical symbols. The description thereof is omitted. In FIG. 18, the control unit 54 controls the drive circuits 61*a* to 61*d* based on setting values 55*a* to 55*d* set to the comparator 60*a* to 60*d*, and outputs a desired voltage to outputs 53*a* to 53*d*, respectively. Currents output from the primary transfer high-voltage power supply circuits 146*a* to 146*d* flow through the current detection circuit 147 via the primary transfer rollers 26*a* to 26*d*, photosensitive drums 22*a* to 22*d* and the ground point 57. This point is also identical to FIG. 4A. A voltage proportional a value on which the currents from the output terminals 53*a* to 53*d* have been superimposed appears at the detection voltage 56.

Also in FIG. 18, as with FIG. 4A, the inverted input terminal of the operational amplifier 70 is virtually grounded to the reference voltage 73, thereby being a constant voltage. Accordingly, there is little possibility in that the voltage of the inverted input terminal of the operational amplifier 70 varies due to operation of the primary transfer high-voltage power supply circuits for other colors and this variation affects operation of the primary transfer high-voltage power supply circuits for the other colors. In other words, the primary transfer high-voltage power supply circuits 146*a* to 146*d* are not affected by each other and operate as with the case of the primary transfer high-voltage power supply circuit 46 in FIG. 4A.

On the other hand, details of the primary transfer high-voltage power supply circuit 46 and the current detection circuit 47 illustrated in FIG. 17B are analogous to those of the primary transfer high-voltage power supply circuit 46*a* and the current detection circuit 47*a* illustrated in FIGS. 2A and 2B. The detailed description thereof is also identical to that in FIGS. 2A and 2B.

FIGS. 17A and 17B are different from each other only in that a single current source or a plurality thereof is included. The detection of current is operated according to an analogous mechanism. Accordingly, in following detection of current, description will be made adopting the high-voltage power supply device in FIG. 17A as an example.

[Description on Misregistration Correction Control]

Next, processing will be described that the current detection circuit common to the primary transfer high-voltage power supplies (process unit) detects the electrostatic latent images 80*a* to 80*d* and executes the misregistration correction control using the configuration illustrated in FIGS. 17A, 17B and 18.

[Flowchart of Reference Value Obtaining Processing]

Figure 19:
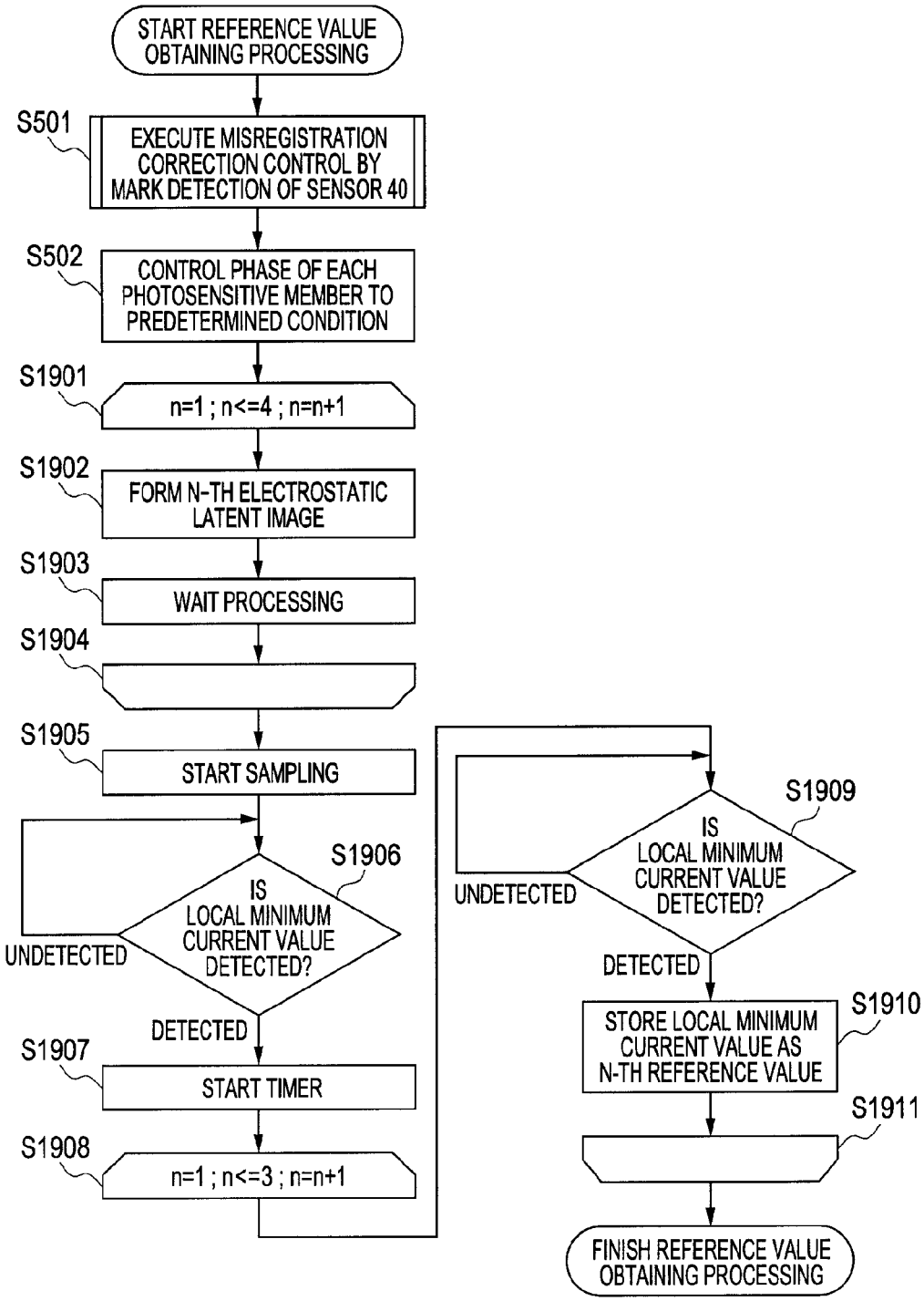
FIG. 19 is a flowchart illustrating another reference value obtaining processing.

FIG. 19 is a flowchart of reference value obtaining processing in the misregistration correction control. The processing of first steps S501 and S502 is as illustrated in FIG. 5.

Figure 20:
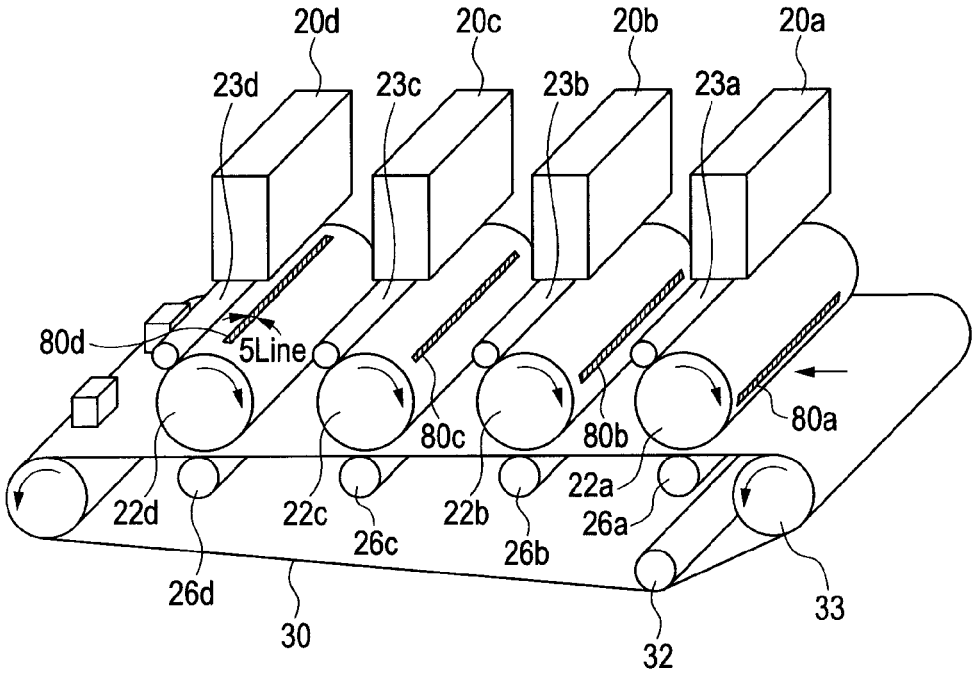
FIG. 20 is a diagram illustrating a state of formation of electrostatic latent images for detecting misregistration (for misregistration correction) for respective colors on the photosensitive drum.

Next, in steps S1901 to S1904, loop processing for n=1 to 4 is executed and an electrostatic latent image for misregistration correction is formed. Provided that the electrostatic latent image formed here is a first electrostatic latent image for misregistration correction control, an electrostatic latent image to be formed in an after-mentioned flowchart of FIG. 21 can be discriminated therefrom as a second electrostatic latent image for misregistration correction. FIG. 20 illustrates a state where the electrostatic latent images for misregistration correction 80*a* to 80*d* are formed on the photosensitive drums 22*a* to 22*d* immediately after completion of the loop processing.

First, in step S1902 in the loop processing for n=1, the control unit 54 causes the scanner unit 20*a* for yellow to emit a laser light beam and form an electrostatic latent image for misregistration correction 80*a* onto the photosensitive drum 22*a*. At this time, the control unit 54 moves the developing sleeve 24*a* to be separated from the photosensitive drum 22*a*. As described in step S503, the voltage output from the high-voltage power supply circuit (development high-voltage power supply circuit) 44*a* may be set to zero. A bias voltage with a polarity inverted to a normal one may be applied to the output voltage. Also in step S1902, the developing sleeve 24*a* arranged upstream to the primary transfer roller 26*a* is operated to be separated or to reduce the action thereof on the photosensitive drum in comparison with the case of forming a normal toner image by the image forming unit. The measures are continued until the flowchart is finished.

Subsequently, in step S1903, the control unit 54 executes waiting processing for a certain time. This processing is for preventing the detection result of the electrostatic latent image formed for the respective colors from being overlapped with each other. Even if the maximum misregistration assumed in the image forming apparatus occurs, the waiting time is set so as not to overlap the electrostatic latent images with each other. The time for the waiting processing may be less than the time for one revolution of the photosensitive drum.

Hereinafter, in an analogous manner, the control unit 54 forms an electrostatic latent image 80*b* in the loop processing for n=2, forms an electrostatic latent image 80*c* in the loop processing for n 3, and forms an electrostatic latent image 80*d* in the loop processing for n=4 on the photosensitive drum, as with the case for n=1. In this embodiment, the electrostatic latent images 80*a* to 80*d* are formed on the photosensitive drums 22*a* to 22*d*, respectively, in a sequence of yellow for n=1, magenta for n=2, cyan for n=3 and black for n=4. The sequence is not limited thereto. It is a matter of course that another sequence different therefrom may be adopted and execution can be made.

The description will be returned to the flowchart of FIG. 19. In next step S1905, the control unit 54 starts sampling of the detection value of the current detection circuit 47. The sampling frequency at this time may be, for instance, about 10 kHz.

Subsequently, in step S1906, the control unit 54 determines whether or not the detection value of the primary transfer current becomes the local minimum by detection of the electrostatic latent image 80 based on the data obtained by sampling. The fact that the detection value indicates the local minimum value means that the electrostatic latent image 80*a* formed first reaches the position of the primary transfer roller 26*a*. In other words, this detection in step S1906 allows detection of the electrostatic latent image 80 formed on the photosensitive drum passing through the position facing to the primary transfer roller as the process unit. The detection current of the current detection circuit 47 here is a value in which currents flowing to the primary transfer rollers 26*a* to 26*d* via the resistance 71 are superimposed. When the local minimum current value is detected in step S1906, the timer is started in step S1907.

Subsequently, in step S1908 to S1911, the control unit 54 executes loop processing for n=1 to 3. In the loop processing, the control unit 54 measures a temporal difference between the timing on which the detection value of the reference color becomes the local minimum and timings on which the detection values of the measurement colors (Y, M and C) become the local minimum. In step S1909, the times (timer values) are measured on which the detection values become the local minimum due to the electrostatic latent images 80*b* to 80*d* of second (n=1) to fourth (n=3) colors causes. In step S1910, the measured time is stored as the n-th reference value in the EEPROM 324. Information stored here indicates the reference condition to be a target when the misregistration correction control is executed. In the misregistration correction control, the control unit 54 executes control so as to cancel the deviation from the reference condition, in other words, to return the condition to the reference condition. The reference value stored here represents, for n=1, the difference of the timing on which the electrostatic latent image for yellow reaches and the timing on which the image for magenta reaches. The value represents, for n=2, the difference of the timing on which the electrostatic latent image for yellow reaches and the timing on which the image for cyan reaches. The value represents, for n=3, the difference of the timing on which the electrostatic latent image for yellow reaches and the timing on which the image for black reaches.

[Flowchart of Misregistration Correction Control]

Figure 21:
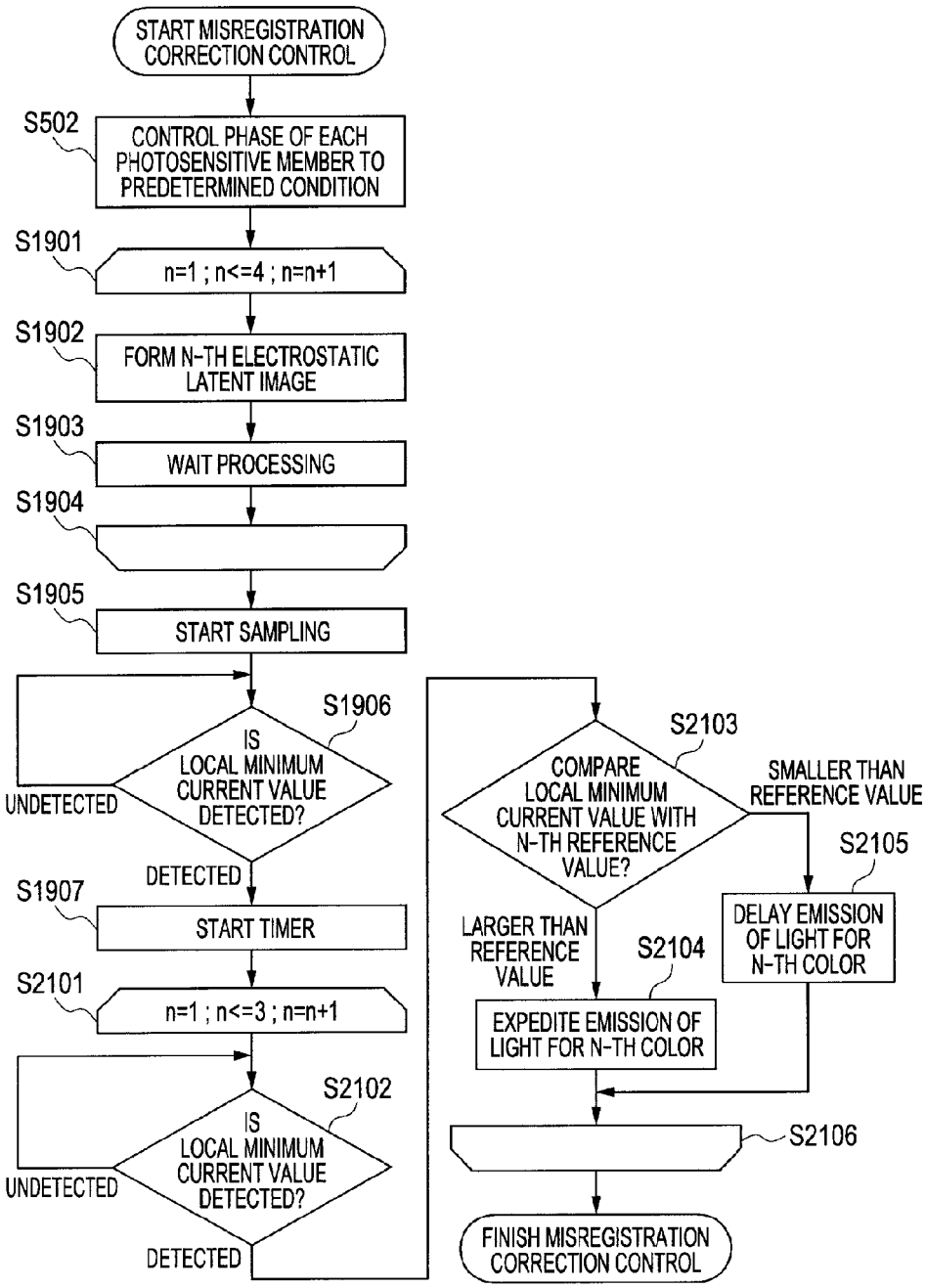
FIG. 21 is a flowchart illustrating another misregistration correction control.

FIG. 21 is a flowchart illustrating misregistration correction control in this embodiment. The processing in steps S502 to S1907 is analogous to that in FIG. 19. Accordingly, the description thereof is omitted.

Next, in steps S2101 to S2106, the control unit 54 executes the loop processing for n=1 to 3. In step S2102, the control unit 54 sets n=1, and measures time (timer value) in which the detection result of the reference color becomes the local minimum and then the detection value becomes the local minimum, as with step S1909 in FIG. 19. In step S2103, the control unit 54 compares the time measured in step S2102 with the reference value corresponding to the value of n stored in step S1910 in FIG. 19.

If the measured time is larger than the stored reference value, the control unit 54 executes correction so as to advance the timing of emitting the laser beam for magenta during printing in step S2104. The setting of how much the control unit 54 advances the timing of emitting the laser beam may be adjusted according to how large the measured time is in comparison with the reference value. On the other hand, if the detected timer value is smaller than the reference value, the control unit 54 delays the timing of emitting the laser beam for magenta during printing in step S2105. The setting of how much the control unit 54 delays the timing of emitting the laser beam may be adjusted according to how small the measured time is in comparison with the reference value. The processing in steps S2104 and S2105 allows the present misregistration condition to be returned to the misregistration condition (reference condition) as the reference. Hereinafter, in an analogous manner, the control unit 54 sets that n=2, and executes the processing in steps S2101 to S2106 for cyan; the control unit 54 sets that n=3, and executes the processing in steps S2101 to S2106 for black.

In the above description, the example is adopted in which the process unit for detecting current is the primary transfer rollers 26*a* to 26*d*. However, the charging roller and the developing sleeve may be adopted as the process unit for detecting current.

In the case of the charging roller, the current detection circuit common to one or plurality of charged high-voltage power supply circuits may be provided, and the flowcharts of FIGS. 19 and 21 may be executed using the current detection circuit. This corresponds to a charged high-voltage power supply circuit, which will be described later in Embodiment 5. Operations of the developing sleeves and the transfer rollers in the case where the current detection circuit of the charged high-voltage power supply circuit is used will be described in detail in Embodiment 5.

In the case of the developing sleeves, a current detection circuit may be provided common to a single or a plurality of development high-voltage power supply circuits, and the flowcharts of FIGS. 19 and 21 may be executed by current detection circuit. The way of how to control the output voltage from the single or plurality of development high-voltage power supply circuits is as described in Embodiment 3.

As described above, in this embodiment, the control unit 54 executes the waiting processing in S1903 so as not to overlap the respective detection timings of the electrostatic latent image with each other. Accordingly, the current detection circuit 147 can be used common to the primary transfer high-voltage power supply circuits 46*a* to 46*d* as the electrostatic latent image process unit. This usage allows the configuration related to the current detection circuit to be simplified.

This embodiment cannot measure and correct the positional deviation for yellow adopted as the reference. However, relative amounts of misregistration of the other colors (measurement colors/detection colors) in the case of adopting yellow as the reference can be corrected. Thus, the absolute positional deviations of the respective colors are almost incapable of being discriminated from each other. Accordingly, sufficient print quality as with the Embodiments can be obtained. In this embodiment, yellow is adopted as the reference color. However, it is a matter of course to execute the above Embodiments while adopting another color as the reference color.

Processing analogous to that of the flowcharts of FIGS. 5 and 10 and FIGS. 12 and 13 illustrated in Embodiments 1 to 3 can be executed using the common current detection circuit 147 illustrated in Embodiment 4. In this case, the processing in step S1906 in FIG. 19 is omitted, and the loop processing in step S1908 to S1911 are executed for n=1 to 4. Subsequently, in the flowchart of FIG. 21, the processing in S1906 may be omitted, and the processing in steps S2101 to S2106 may be executed for n=1 to 4. In the case of using the charged high-voltage power supply circuit and the development high-voltage power supply circuit instead of the primary transfer high-voltage power supply circuit, the above processing may be executed in an analogous manner.

Embodiment 5

In the above Embodiments, the description has been made such that the current detection circuit common to the plurality of process units is used and the electrostatic latent images 80*a* to 80*d* for correction are formed at the specific positions (phases) in the photosensitive drums 22*a* to 22*d*. Further, in the case of using the current detection circuit common to the process units for the plurality of colors, the electrostatic latent image for misregistration correction may be formed irrespective of the position (phase) of the photosensitive drum, thereby allowing misregistration correction, as described in Embodiment 2. The mode thereof will hereinafter be described.

[Diagram of Configuration of High-Voltage Power Supply Device]

Figure 16C:
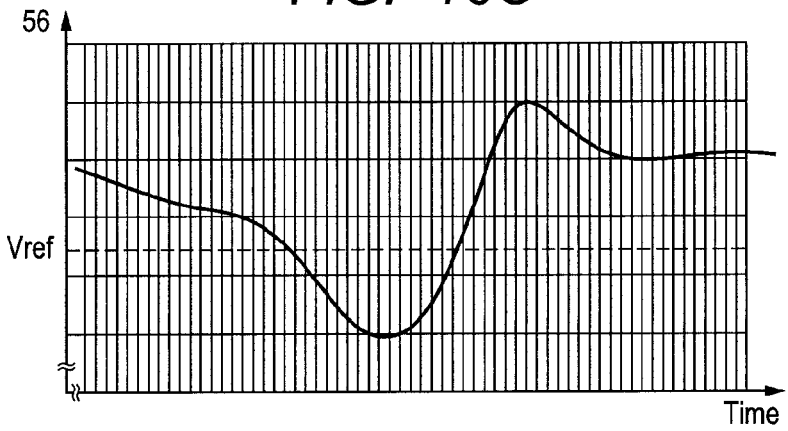
FIG. 16C is a diagram illustrating an example of a result of detecting surface potential information of the photosensitive drum.
Figure 22:
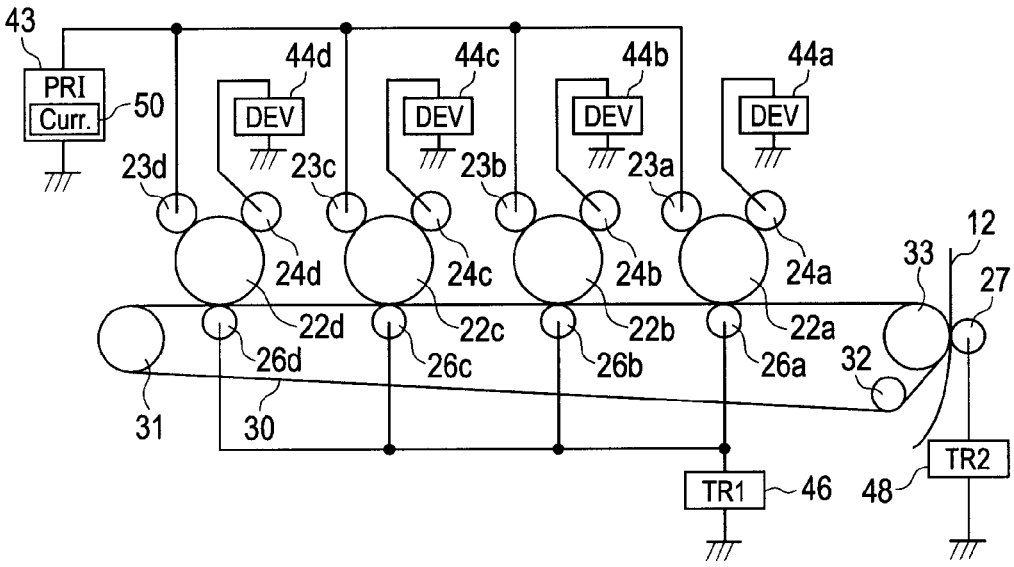
FIG. 22 is a diagram of a configuration of another high-voltage power supply device.

FIG. 22 illustrates a configuration of a high-voltage power supply device in Embodiment 5. The configurational elements identical to that of FIGS. 2A, 2B, 17A and 17B are assigned with the identical reference symbols. There is a difference in that the charged high-voltage power supply circuit 43 is provided with a current detection circuit 50 common to the charging rollers 23*a* to 23*d* as the process units. That is, in this embodiment, processing of detecting a value of current flowing via the charging rollers 23 and the photosensitive drums 22 will be described. The details of the circuit configurations of the charged high-voltage power supply circuit 43 and the current detection circuit 50 are as illustrated in FIGS. 16A to 16C (43*a* and 50*a*). Here, the detailed description thereof is omitted.

Also. FIG. 22 only illustrates the case where the charged high-voltage power supply circuit is common to the charging rollers 23*a* to 23*d*. However, the configuration is not limited thereto. As with the primary transfer high-voltage power supply circuits 146*a* to 146*d* illustrated in FIG. 17A, the case of separately providing the charging rollers 23*a* to 23*d* with respective charged high-voltage power supply circuits may be applied. This is because the difference is only in that a single or a plurality of the current sources is provided and current detection is operated in an analogous manner.

[Flowchart of Reference Value Obtaining Processing]

Figure 23A:
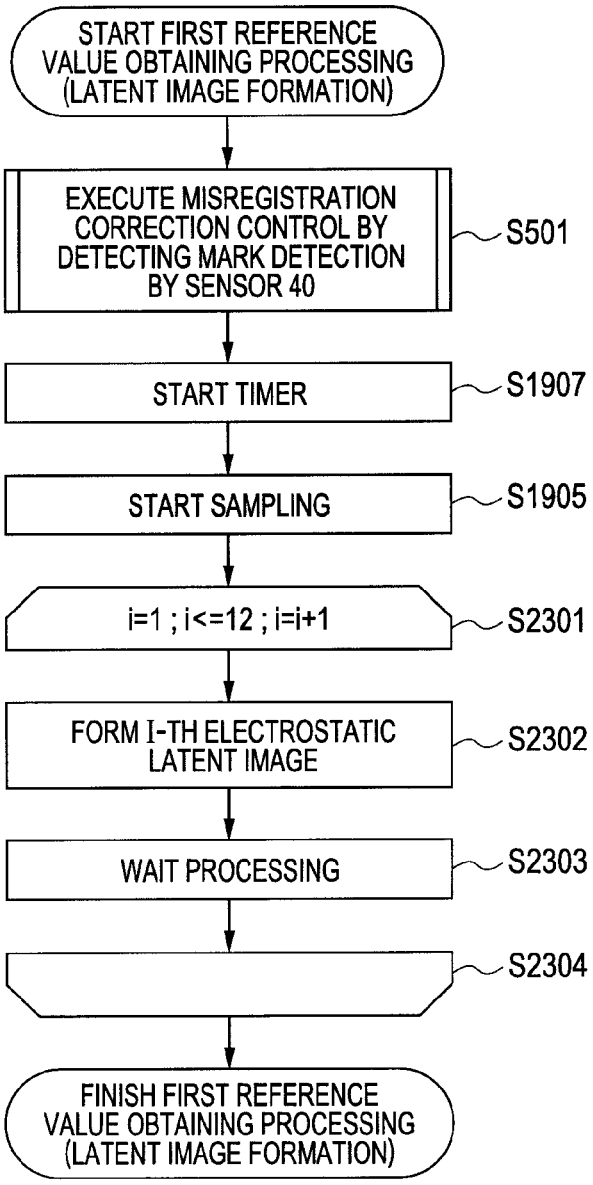
FIG. 23A is a flowchart illustrating another reference value obtaining processing.

Flowcharts illustrating reference value obtaining processing in misregistration correction control of this embodiment will be described using FIGS. 23A, 23B and 24. First, the processing in step S501 initially executed in the flowchart of FIG. 23A is as illustrated in FIG. 5. Before processing in step S1907 in FIG. 23A, preparation for forming the electrostatic latent image for misregistration correction on the photosensitive drum is executed on timings T1 to T3 in FIG. 24. A condition before the timing T1 in FIG. 24 represents a condition immediately after the misregistration correction control in step S501 has been executed. The immediately-after-condition here indicates a condition in which the misregistration correction control in step S501 is reflected almost as it is.

First, the control unit 54 outputs a drive signal for driving cams for separating the developing sleeves 24*a* to 24*d* at the timing T1. At the timing T2, operation is made from a condition where the developing sleeves 24*a* to 24*d* are contact with the photosensitive drums 22*a* to 22*d*, respectively, to a separated condition. The control unit 54 controls the primary transfer high voltage from an on condition to an off condition at the timing T3. As to the off condition of the primary transfer high voltage, more specifically, the control unit 54 sets the setting value 55 to zero in the circuit in FIG. 4A. In the circuit in FIG. 18, the control unit 54 sets the setting values 55*a* to 55*d* to zero. As illustrated in the above Embodiment, instead of separating the developing sleeve 24 at the timing T1, the voltages output from the development high-voltage power supply circuits 44*a* to 44*d* may be set to zero. Instead, a voltage with a polarity inverted from a normal one may be applied. As to the primary transfer rollers 26*a* to 26*d*, instead of turning off the primary transfer high voltage, the rollers may be separated.

The description will be returned to FIG. 23A. The control unit 54 starts the timer in step S1907 after the timing T3, and starts sampling in step S1905. The processing thereof is as illustrated in the above Embodiment.

Next, the control unit 54 executes the loop processing for n=1 to 12 in steps S2301 to 2304. In step S2302 in the loop processing, the control unit 54 sequentially outputs twelve signals in total, which are laser signals 90*a* to 90*d*, 91*a* to 91*d* and 92*a* to 92*d*. According to the signal output here, the scanner units 20*a* to 20*d* executes light emission. The developing sleeves 24*a* to 24*d* and the primary transfer rollers 26*a* to 26*d* arranged upstream to the charging rollers 23*a* to 23*d* at which the electrostatic latent image is detected is operated so as to be separated or at least reduce the action on the photosensitive drum in comparison with the case of the normal case of forming a toner image. This point is as with the above Embodiments. Further, the measures are continued until the flowchart of FIGS. 23A and 23B is finished. This point is also analogous thereto. The waiting time for the waiting processing in step S2303 is set according to the technical reason analogous to that in S1903 in FIG. 19.

The timings T1 to T6 in FIG. 24 correspond to the loop processing for n=1 to 12. A state where the electrostatic latent images for misregistration correction are sequentially formed. Further, in FIG. 24, in the period of timings T4 to T6, as to the photosensitive drum for the respective colors, the electrostatic latent image for misregistration correction is formed for about every one-third period of the photosensitive drum. In the figure, in an order of the laser signals 90*a*, 90*b*, 90*c*, 90*d*, 91*a*, 91*b*, 91*c*, 91*d*, 92*a*, 92*b*, 92*c* and 92*d* form the respective electrostatic latent images. As illustrated in the description of current detection circuit 147 in FIG. 18, the current value to be detected has a value in which the currents flowing in the charging rollers 23*a* to 23*d* are superimposed. The current detection signals 95*a* to 95*d*, 96*a* to 96*d* and 97*a* to 97*d* illustrated in the figure are not completely superimposed. The electrostatic latent image is formed as illustrated. Here, the current detection signals correspond to the detection voltage 56 and the detection voltage 561 described above.

Next, FIG. 23B will be described. FIG. 23B illustrates processing of detecting the electrostatic latent images for misregistration correction formed in the flowchart of FIG. 23A. As indicated by the timing T5 in FIG. 24, before formation of the electrostatic latent image for misregistration correction is completed, detection of the electrostatic latent image for misregistration correction is started. Accordingly, a part of processing illustrated in FIG. 23B is executed by the control unit 54 in parallel with the processing of FIG. 23A.

First, in steps S2311 to S2314, the control unit 54 executes the loop processing for i=1 to 12. In step S2312, the control unit 54 measures reaching times ts(i) (i=1 to 12) from the reference timing of the twelve electrostatic latent images formed in the processing in FIG. 23A. According to the detection processing in step S2312, it can be detected that each electrostatic latent image formed on the photosensitive drum passes through the position facing to the charging roller. In step S2313, actual measurement results are temporarily stored in the RAM 323. In the processing in step S2313, the plurality of detection results are stored, these detection results become an actual measurement result (a first actual measurement result) in which the component of the rotation cycle of the photosensitive drum has at least been reduced.

A state where the current detection is changed in the timings T5 to T7 in FIG. 24 is illustrated. Results 95*a* to 95*d* are obtained by detecting variation of the current detection signal according to the electrostatic latent image formed by the laser signals 90*a* to 90*d*. Likewise, results 96*a* to 96*d* are detection results of the laser signals 91*a* to 91*d*; results 97*a* to 97*d* are detection results of the laser signals 92*a* to 92*d*. The detection timings are not overlapped with each other. Accordingly, the current detection circuit common to the process units (charging roller) to be detected can be applied.

Subsequently, in step S2315 to S2318, the control unit 54 executes loop processing for k=1 to 3. In step S2316, the control unit 54 executes a following logic operation for each value of k. The method of the operation may be executed by the CPU 321 based on program code. Instead, the method may be executed using one of a hardware circuit and a table. The method is not specifically limited thereto.

$$\delta esYM(k)=ts(4\times(k-1)+1+1)-ts(4\times(k-1)+1) \quad \text{Equation 18}$$

$$\delta esYC(k)=ts(4\times(k-1)+1+2)-ts(4\times(k-1)+1) \quad \text{Equation 19}$$

$$\delta esYBk(k)=ts(4\times(k-1)+1+3)-ts(4\times(k-1)+1) \quad \text{Equation 20}$$

More specifically, in step S2316, the control unit 54 calculates, for k=1, amounts of misregistration δesYM(1), δesYC (1) and δesYBk(1) in the sub-scanning direction for respective colors in the case of adopting yellow as the reference for the first time from the measurement values of ts(1) to ts(4) based on above Equations 18 to 20. As illustrated in FIG. 24, results ts(1) to ts(4) are the respective actual measurement results corresponding to yellow, magenta, cyan and black. The control unit 54 stores in the RAM 323 δesYM(1), δesYC (1) and δesYBk(1) calculated in step S2317. Information stored in step S2317 is also an actual measurement result (the first actual measurement result) in which the component of the rotation cycle of the photosensitive drum is at least reduced. The control unit executes analogous processing of the loop for k=2 using the detection results ts(5) to ts(8). The control unit 54 further executes analogous processing of the loop for k=3 using the detection results ts(9) to ts(12).

Finally, in step S2319, the control unit 54 calculates according to Equations 21 to 23 a data calculated in the loop processing in step S2315 to S2318 representing the amounts of misregistration in the sub-scanning direction for the respective colors with reference to yellow with the component of the rotation cycle of the photosensitive drum having been canceled. The data representing the amount of misregistration is not necessarily the amount of misregistration itself, provided only that the data correlated to the misregistration condition.

[Expression 1]

Further, in step S2320, the control unit 54 stores in the EEPROM 324 the calculated δes'YM, δes'YC(1) and δes'YBk as the reference value, which is the data representing the amount of misregistration with the component of the rotation cycle of the photosensitive drum having been canceled. As described, the information stored in step S2320 is the actual measurement result (the first actual measurement result) in which the component of the rotation cycle of the photosensitive drum has at least been reduced. The information stored here represents the reference condition to be a target in the case of executing the misregistration correction control. In the misregistration correction control, the control unit 54 executes control so as to cancel the deviation from the reference condition, in other words, to return the condition to the reference condition. The information stored in steps S2313 and S2317, which is a basis of the information stored in step S2320, can be regarded as the reference condition in the misregistration correction.

[Flowchart of Misregistration Correction Control]

Figure 25A:
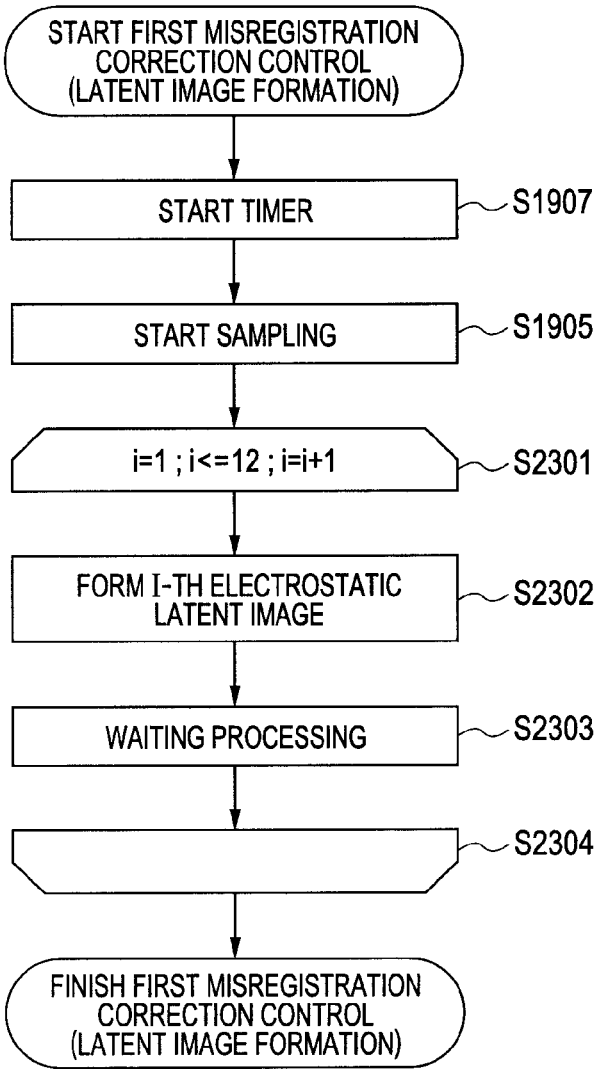
FIG. 25A is a flowchart illustrating another misregistration correction control.
Figures 1, 25B:
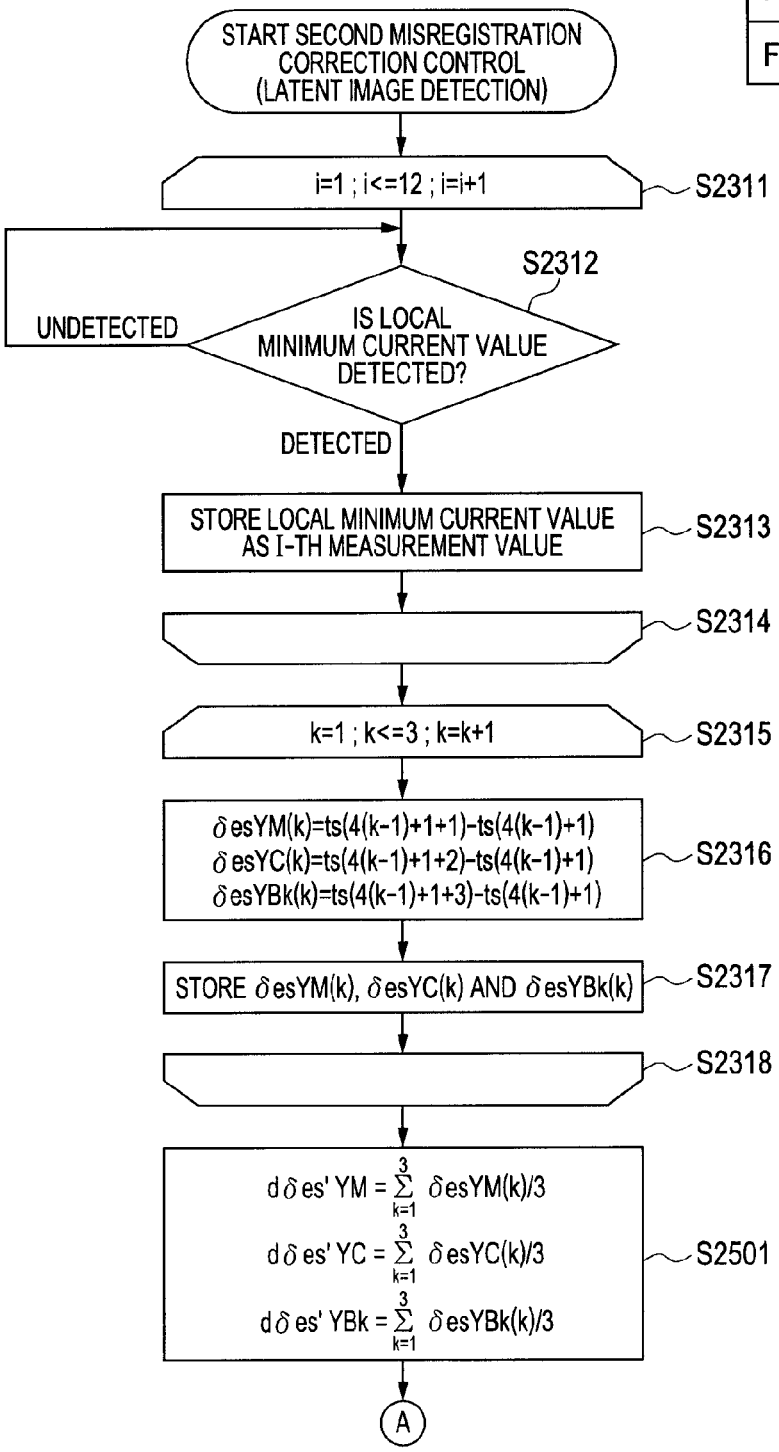
FIG. 25B is comprised of FIGS. 25B-1 and 25B-2 are flowcharts illustrating another misregistration correction control.
Figures 2, 25B:
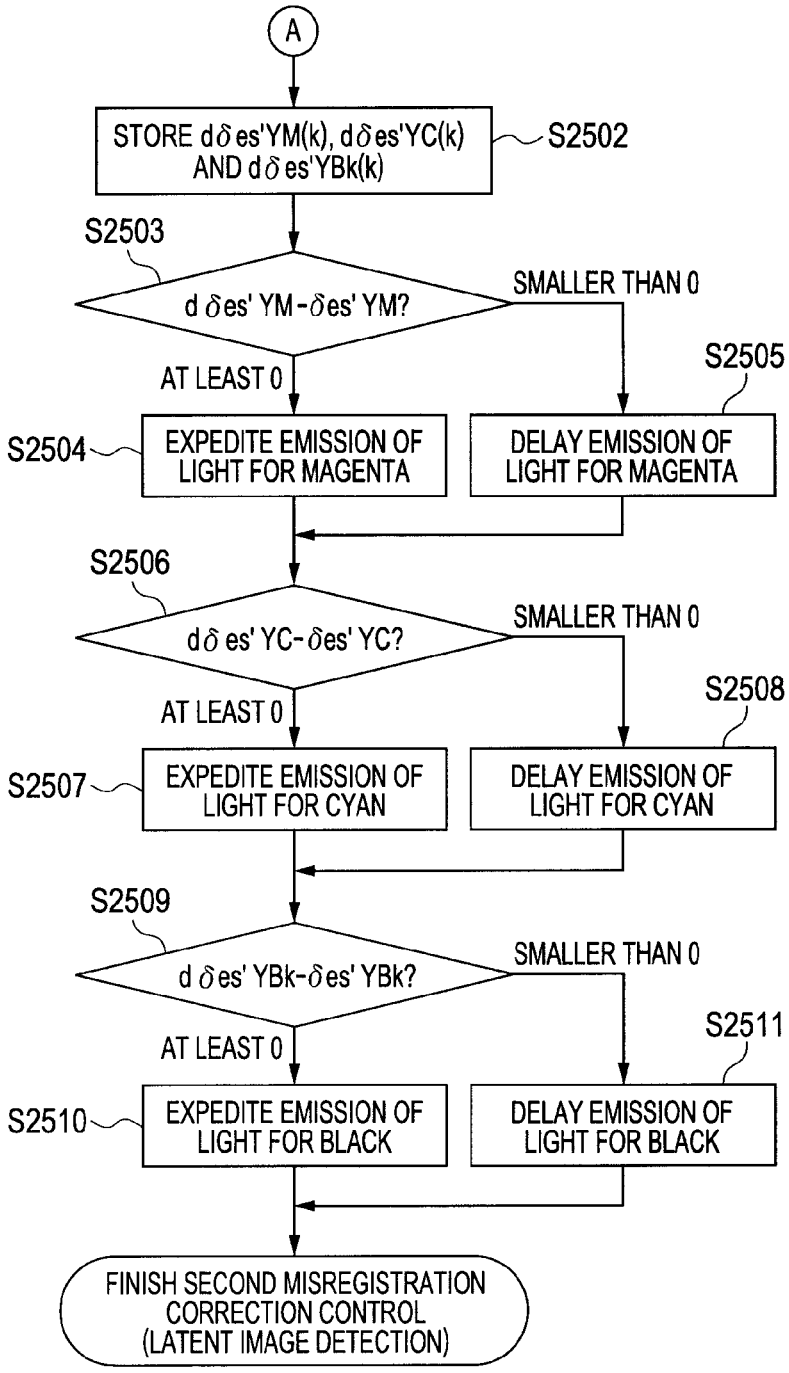

Next, the misregistration correction control in this embodiment will be described using flowcharts of FIGS. 25A, 25B-1 and 25B-2. FIG. 25A illustrates processing of forming an electrostatic latent image. FIGS. 25B-1 and 25B-2 illustrate processing of detecting the electrostatic latent image and correcting the laser beam emission timing as the image forming condition. The processing in the steps in FIG. 25A is identical to that in steps S1907 to S2304 in FIG. 23A. Accordingly, the description thereof is omitted. The processing in steps S2311 to S2318 in FIG. 25B-1 is identical to that of step S2311 to S2318 in FIG. 23B-1. Accordingly, the description thereof is omitted. Description will hereinafter be described mainly on a difference from FIGS. 23A and 23B.

In step S2501, the control unit 54 calculates (dδes'YM), (6δes'YC) and (dδes'YBk) based on the actual measurement result stored in step S2317 in FIG. 25B-1. A prefix "d" is attached to indicate meaning of an actually detected result value. The details of specific calculation are substantially as illustrated in Equations 21 to 23 above. In step S2502, the control unit 54 temporarily stores the calculation result (second actual measurement result) in the RAM 323.

Figure 23B:
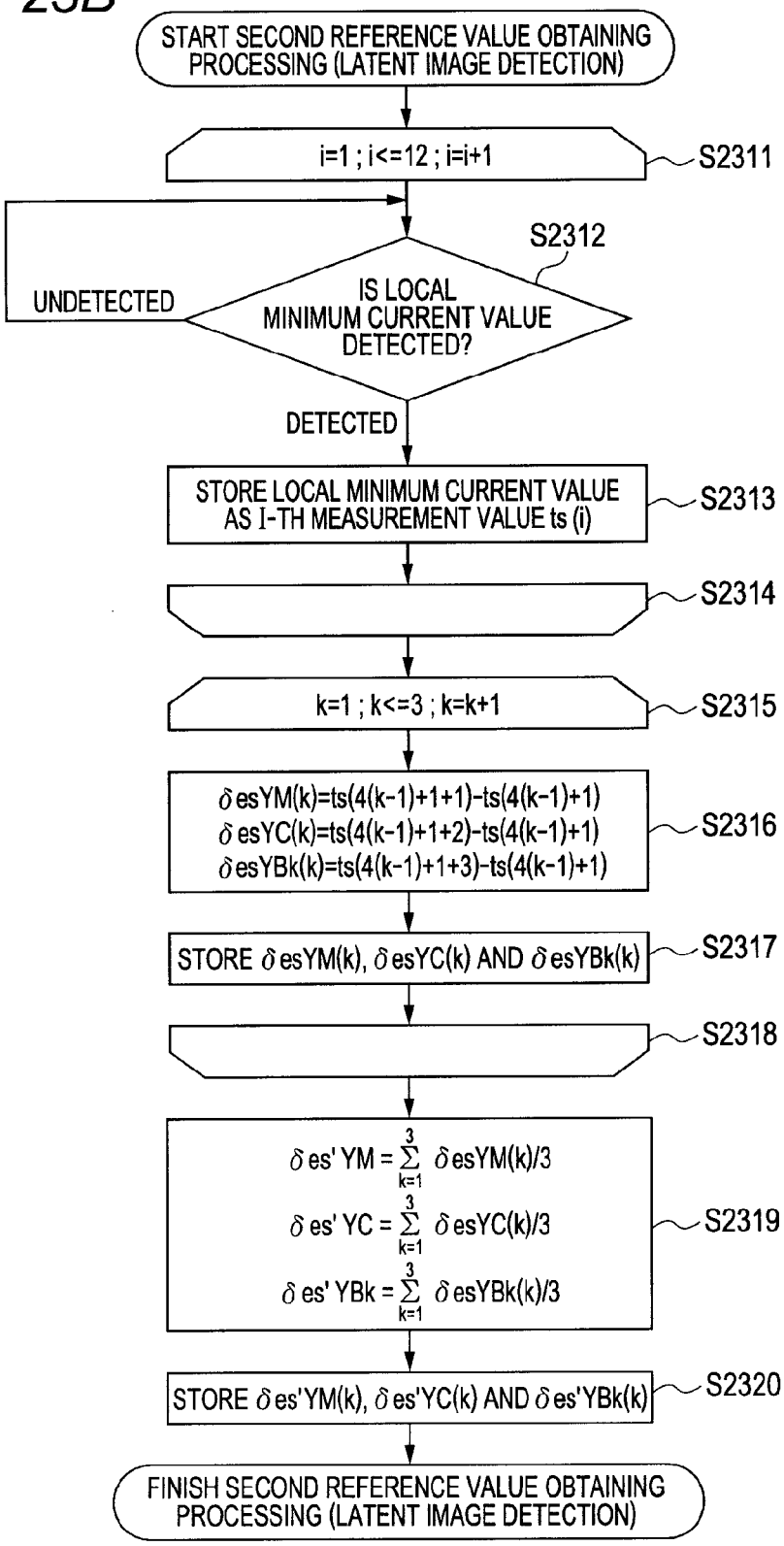
FIG. 23B is a flowchart illustrating another reference value obtaining processing.
Figure 24:
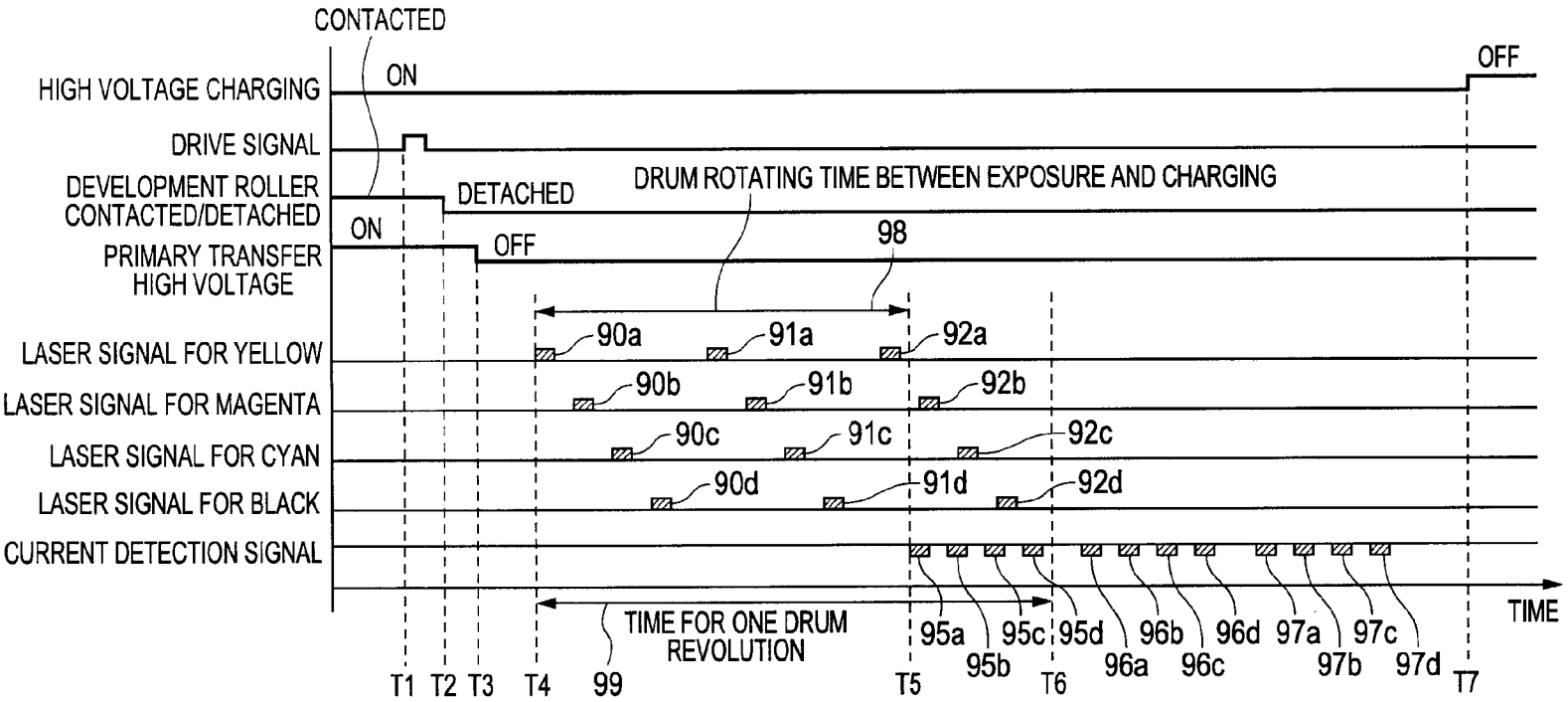
FIG. 24 is a timing chart on formation of an electrostatic latent image for detecting misregistration (for misregistration correction).

In step S2503, the control unit 54 obtains a difference between dδes'YM calculated in step S2502 and δes'YM stored in step S2320 in FIG. 23B. In a case where the difference is at least zero, that is a case where the magenta detection timing with respect to the yellow detection timing is delayed in comparison with the reference, the control unit 54 advances timing of emitting the laser beam for magenta according to the difference value as with S1002 in FIG. 5. On the other hand, in a case where the difference is less than zero, that is a case where magenta detection timing with respect to yellow detection timing is advanced in comparison with the reference, the control unit 54 delays the timing of emitting the laser beam for magenta according to the difference value. This allows the amount of misregistration between yellow and magenta to be suppressed.

Also in steps S2506 to 2511, the control unit 54 corrects the timing of emitting the laser beam as the image forming condition for cyan and black, as with the case of magenta. Thus, the flowcharts of FIGS. 25B-1 and 25B-2 also allow the present misregistration condition to be returned to the misregistration condition (reference condition) as the reference.

In the description of this embodiment, the electrostatic latent images 80 are formed in photosensitive drum phases and then in step S2319 stores the reference value in which the photosensitive drum component of the rotation cycle has been canceled according to the detection result. Subsequently, in FIGS. 25A, 25B-1 and 25B-2, the electrostatic latent images 80 are formed in the photosensitive drum phases again. The actual measurement result in which the obtained photosensitive drum rotation cycle component has been canceled according to the detection result is obtained. The obtained result is compared with the reference value having preliminarily been calculated and stored. However, for instance, another calculation method that does not execute comparison with the reference value preliminarily obtained as the average value may be assumed. For instance, the data obtained in step S2301 in FIG. 23A and step S2301 in FIG. 25A are preliminarily stored. The control unit 54 may finally calculate a data corresponding to the amount of misregistration in which the rotation cycle component of the photosensitive drum is canceled using the stored data.

The description will be made using an example of calculation of a relative amount of misregistration between yellow and magenta. It is provided that the data obtained in steps S2311 to S2314 in FIG. 23B are ts(i) (i=1 to 12) and the data obtained in steps S2311 to S2314 in FIG. 25B-1 are ts'(i) (i=1 to 12). The difference between yellow as the reference color and magenta as the measurement color is calculated by control unit 54 according to following Equation 24.

$$\{(ts'(2)+ts'(6)+ts'(10))-(ts'(1)+ts'(5)+ts'(9))\}-\{(ts(2)+ts(6)+ts(10))-(ts(1)+ts(5)+ts(9))\} \quad \text{Equation 24}$$

(ts'(2)+ts'(6)+ts'(10)) in Equation 24 corresponds to the second actual measurement result for magenta with the rotation cycle component of the photosensitive drum having been canceled; (ts'(1)+ts'(5)+ts'(9)) corresponds to that for yellow. (ts(2)+ts(6)+ts(10)) corresponds to the first actual measurement result for magenta with the rotation cycle component of the photosensitive drum having been canceled; (ts(1)+ts(5)+ts(9)) corresponds to that for yellow. The difference with another color may be calculated by the control unit 54 in an analogous manner.

In a case where, in the calculation result according to Equation 24 by the control unit 54, for instance, the difference after an elapsed time is smaller than an initial difference between magenta and yellow, the control unit 54 delays the timing of emitting the laser beam (light emission timing) for magenta as the measurement color. This is measures as with the processing in steps S2505, S2508 and S2511 in FIG. 25B-2. In a case where the calculation result is positive, control reversed from a negative case is executed by the control unit 54. An analogous image forming condition control (light emission timing control) is executed for the other colors.

Thus, for instance, another calculation method without comparison with the reference value having preliminarily been obtained as the average value allows the amount of misregistration to be obtained with the rotation cycle component of the photosensitive drum being canceled. This can be applied not only to the flowcharts in FIGS. 23A, 23B, 25A, 25B-1 and 25B-2 but also to, for instance, the flowcharts in FIGS. 12 and 13.

The above description has been made using the charging rollers 23*a* to 23*d* as the process unit for detecting current. However, the primary transfer roller and the developing sleeve can be adopted as the process unit for detecting current.

In a case of the primary transfer roller, a current detection circuit common to a single or a plurality of primary transfer high-voltage power supply circuits may be provided, and the flowcharts in FIGS. 23A and 23B and FIGS. 25A, 25B-1 and 25B-2 may be executed using the current detection circuit. This corresponds to the primary transfer high-voltage power supply circuit illustrated in FIGS. 17A and 17B in Embodiment 4. However, since the primary transfer roller is adopted as the process unit for detecting current, the primary transfer high-voltage power supply circuit is continued to be turned on even after the timing T3 in FIG. 24.

In a case of the developing sleeve, a current detection circuit common to a single or a plurality of development high-voltage power supply circuits is provided, and the flowcharts in FIGS. 23A and 23B and FIGS. 25A, 25B-1 and 25B-2 may be executed using the current detection circuit. The way of how to control the output voltage from the single or plurality of development high-voltage power supply circuits is as illustrated in Embodiment 3.

Thus, in this embodiment, the waiting processing in S1903 is executed by the control unit 54 so as not to overlap the detection timings of the electrostatic latent images with each other. Accordingly, the current detection circuit 147 common to the primary transfer high-voltage power supply circuits 46*a* to 46*d* as the electrostatic latent image process unit can be adopted. This allows the configuration related to the current detection circuit to be simplified.

The misregistration correction control can also be executed in a system analogous to the flowcharts in FIGS. 5 and 10 and the flowcharts in FIGS. 12 and 13 described in Embodiment 1 to 3 using the common current detection circuit 50 described in this embodiment. This processing will be described according to flowcharts of FIGS. 26 and 27.

Figure 26:
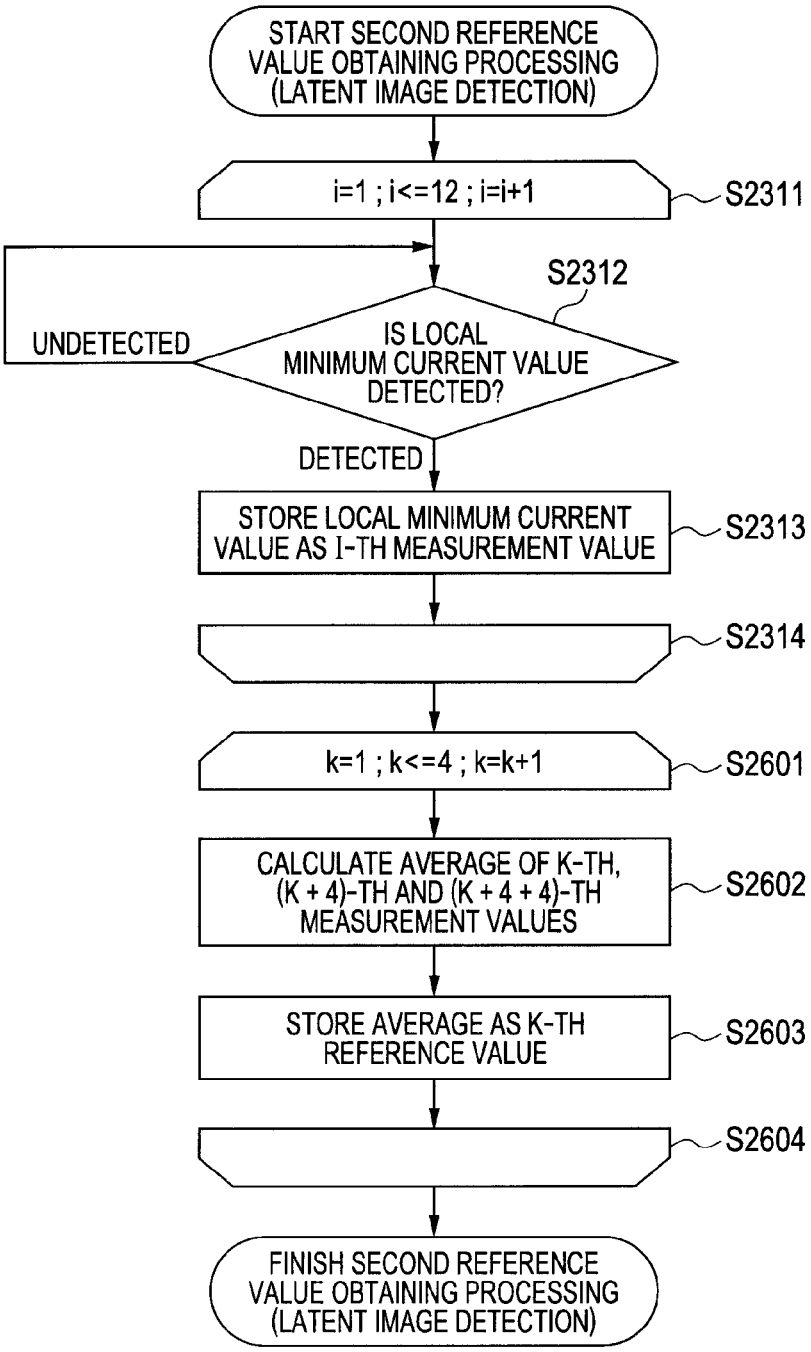
FIG. 26 is a flowchart illustrating another reference value obtaining processing.

In this case, first, the control unit 54 executes the above-mentioned timing chart of FIG. 24. At this time, the flowcharts of FIGS. 23A and 26 are executed in parallel. As to the description of the flowchart of FIG. 26, the processing in steps S2311 to S2314 is analogous to that in FIG. 23B.

In step S2601 to S2604, the control unit 54 executes loop processing for k=1 to 4. In step S2602 in the loop processing for k=1, the control unit 54 calculates the average value of first, (1+4)-th and (1++4)-th measurement values from among the twelve measurement values stored in step S2313 in FIG. 26 and then, in step S2603, stores the calculated value as a first reference value. In a case where an effect on each data owing to decentering of the photosensitive drum is different, the control unit 54 may calculate a weighted average value. The control unit 54 calculates average values also for n=2 to 4 in an analogous manner. The information stored in the loop processing represents the reference condition to be a target in the case of misregistration correction control. In misregistration correction control, the control unit 54 executes control so as to cancel the deviation from the reference condition, in other words, to return the condition to the reference condition.

Figure 27:
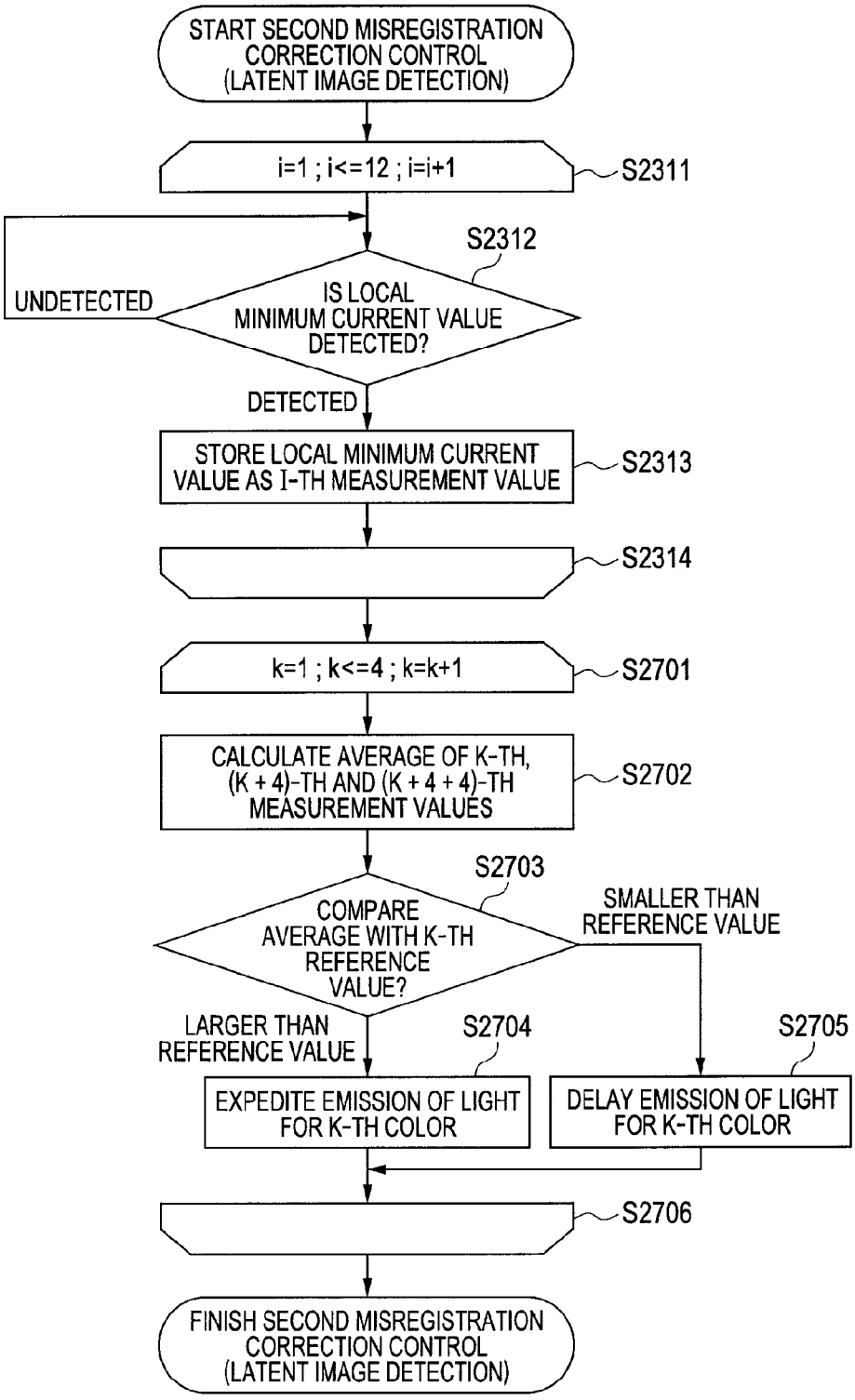
FIG. 27 is a flowchart illustrating another misregistration correction control.

Subsequently, after the predetermined condition has been established, the timing chart in FIG. 24 is executed again in the predetermined condition. Next, the flowcharts in FIGS. 25B-1, 25B-2 and 27 are executed in parallel. The processing in steps S2311 to S2314 in the flowchart of FIG. 27 is analogous to that in FIGS. 25B-1 and 25B-2.

In steps S2701 to S2706, the control unit 54 executes the loop processing for k=1 to 4. In step S2702 in the loop processing for k=1, the control unit 54 calculates again the average value of first, (1+4)-th and (1+4+4)-th measurement values from among the twelve measurement values stored in step S2313 in FIG. 27. In step S2703, the control unit 54 compares the largeness of the average value calculated in step S2702 for k=1 and the first reference value stored in step S2603.

According to the comparison result in step S2703, in a case where the average value calculated in step S2702 for k=1 is larger than the first reference value stored in step S2603, the timing of emitting the laser beam for the first color (yellow) is advanced in step S2704. On the other hand, in the case where the average value is smaller than the reference value, the emission for the first color is delayed in step S2705. Subsequently, also for n=2 to 4, the analogous loop processing is executed. This enables the present misregistration condition to be returned to the misregistration condition (reference condition) as the reference.

In the Embodiment 5, the image forming apparatus including the charged high-voltage power supply circuit has been described. However, it is also assumed to execute the flowcharts FIGS. 26 and 27 using one of the primary transfer high-voltage power supply circuit and the development high-voltage power supply circuit, instead of the charged high-voltage power supply circuit.

Thus, the processing in the flowcharts in FIGS. 23 and 25 in Embodiment 5 may be executed based on references dedicated to the respective colors. Also as to the calculation of the amount of misregistration at this time, for instance, a manner of calculation without comparison with the reference value preliminarily obtained as the average value may be assumed. For instance, the control unit 54 obtains the amounts of misregistration for yellow, magenta, cyan and black by a system of calculation without comparison with the reference value, according to following Equation 25 to 28.

$$(ts'(1)+ts'(5)+ts'(9))-(ts(1)+ts(5)+ts(9)) \quad \text{Equation 25}$$

$$(ts'(2)+ts'(6)+ts'(10))-(ts(2)+ts(6)+ts(10)) \quad \text{Equation 26}$$

$$(ts'(3)+ts'(7)+ts'(11))-(ts(3)+ts(7)+ts(11)) \quad \text{Equation 27}$$

$$(ts'(4)+ts'(8)+ts'(12))-(ts(4)+ts(8)+ts(12)) \quad \text{Equation 28}$$

For instance, Equation 26 will be described. In the case of the calculation result by the control unit 54 according to Equation 26 is negative, the control unit 54 delays the timing of emitting the laser beam (light emission timing) for magenta as the measurement color. This corresponds to, for instance, the case of determining that the value is smaller than the reference value in step S1001 in FIG. 10, the case of determining that the value is smaller than the reference in step S1303 in FIG. 13, the case of determining that the value is smaller than the reference value step S2103 in FIG. 21 and the case of determining that the value is smaller than the reference value in step S2703 in FIG. 27. In the case where the calculation result is positive, the control reversed from the negative case is executed by the control unit 54. The analogous image forming condition control (light emission timing control) is executed for the other colors.

As described above, the detection timings in which the detection section detects the electrostatic latent images for misregistration correction can be set not to overlap with each other so that the electrostatic latent image for misregistration correction can be formed independent from the position (phase) on the photosensitive drum. In this embodiment, although it is explained that the electrostatic latent images for misregistration correction are formed at three portions in total around the peripheral of each of the photosensitive drum (the electrostatic latent images for misregistration correction are formed three times per one revolution of each photosensitive drum), the number of locations to form the electrostatic latent images for misregistration correction is not restricted to three for the peripheral of each of the photosensitive drum. However, the accuracy becomes higher because the more the number of portions where electrostatic latent images for misregistration correction are formed is, the more the number of times where the detection unit detects electrostatic latent images for misregistration correction is. Therefore, the forming section may form the electrostatic latent images for misregistration correction at a plurality of positions on the photosensitive member for each color and execute misregistration correction according to the detection results.

Embodiment 6

In the above Embodiments, it has been described that the processing of obtaining the reference value as the determination reference of the misregistration condition is executed in FIGS. 5, 12, 19, 23A and 23B before the misregistration correction control processing is executed in FIGS. 10, 13, 21, 25A, 25B-1 and 25B-2. However, provided that the condition is returned to a fixed mechanical condition in a case where an elevated temperature in the apparatus is returned to a normal temperature in the apparatus, it is not necessarily to execute the reference value obtaining processing.

A predetermined reference value (reference condition) having been identified in one of a design stage and a manufacturing stage may be adopted instead. The predetermined reference value is used instead of the values stored in step S506 in FIG. 5, step S1208 in FIG. 12, step S1910 in FIG. 19, any one of steps S2313, S2317 and S2320 in FIGS. 23A and 23B and step S2603 in FIG. 26. The predetermined reference condition to be the target in correcting the misregistration condition is stored, for instance, in the EEPROM 324 in FIG. 3 and referred to by the control unit 54 as necessary. According to this reference, each flowchart described above is executed. Thus, the execution of each of the Embodiments is not limited to a mode of detecting the reference condition in misregistration correction control each time and storing the detected reference condition.

In the case of preliminarily storing in the EEPROM 324 the reference value adopted instead of the values stored in steps S506 and S1208, a predetermined rotational phase is associated with the stored reference value and stored together. The control unit 54 refers to the stored information of the predetermined rotational phase and forms the electrostatic latent image for misregistration correction as in steps S503 and S1203 at the predetermined rotational phase having been referred to. However, in a case where n times of electrostatic latent images for misregistration correction formed in steps S1203 to S1205 exceed one revolution of the photosensitive drum, there is no need to store the predetermined rotational phase associated with the reference value.

[Variation]

The image forming apparatus including the intermediate transfer belt 30 has been described above. However, application can be made to another system of the image forming apparatus. For instance, application can be made to the image forming apparatus adopting a system that includes a recording material transfer belt and directly transfers a toner image developed on each photosensitive drum 22 onto the transfer material (recording material) transferred by the recording material transfer belt (endless belt). In this case, the toner mark for detecting misregistration as illustrated in FIG. 6 is formed on the recording material transfer belt (endless belt).

The description has been made using the example of adopting the primary transfer roller 26*a* as the primary transfer section. However, for instance, a contact type of primary transfer section using a transfer blade may be applied. Instead, a primary transfer section that forms a primary transfer nip portion by surface pressure as illustrated in Japanese Patent Application Laid-Open No. 2007-156455 may be applied.

In the above description, the current information is detected by the current detection circuit 47*a* as the surface potential information in which the surface potential of the photosensitive drum has been reflected. This is because the control unit 54 executes constant voltage control during primary transfer in the image formation. Further, a certain constant current application system that applies a transfer voltage to the primary transfer section has been known as another primary transfer system. That is, it is also assumed to adopt constant current control as a primary transfer system in image formation. In this case, variation of voltage is detected as surface potential information in which the surface potential of the photosensitive drum is reflected. The processing analogous to that in the above-mentioned flowchart may then be performed on the time until a characteristic shape of variation of voltage is detected as with the case in FIG. 8. This also holds in the charged high-voltage power supply circuits 43*a* to 43*d*, the development high-voltage power supply circuits 44*a* to 44*d* described in Embodiment 3 and the high-voltage power supply device described in Embodiments 4 and 5.

In Embodiments 4 and 5, the case of adopting high-voltage power supply circuit in which the current detection circuit is common to the process units has been described. However, the technique is not limited thereto. This processing can also be executed adopting, for instance, the high-voltage power supply circuit illustrated in FIGS. 2A and 2B and the development high-voltage power supply circuits 44*a* to 44*d* illustrated in FIGS. 16A and 16B in Embodiment 3.

Further, the description has been made using the color image forming apparatus as the example in the above Embodiments. However, the electrostatic latent image for misregistration correction can be used as an electrostatic latent image for detection for another application. For instance, in a monochrome printer, this can be utilized for a case of appropriately controlling a position where a toner image is formed on a recording material. In this case, an ideal time from formation of an electrostatic latent image for detection on a photosensitive drum to detection of the electrostatic latent image for detection at one of a development nip portion, a transfer nip portion and a charging nip portion is preliminarily stored in the EEPROM 324. The control unit 54 then compares one of the result measured in step S505 in FIG. 10 and the result calculated in step S1302 in FIG. 13 with the preliminarily stored ideal time. This ideal time corresponds to the reference value in the flowcharts in FIGS. 10 and 13. According to the largeness thereof, processing analogous to that in steps S1001 to S1003 in FIG. 10 and steps S1303 to S1305 in FIG. 13 may be executed. This allows the light emission position on the photosensitive drum to be corrected to the appropriate position and enables the toner image formation position on the recording material to be corrected to the appropriate condition. Accordingly, for instance, in a case of form-printing on a preprint sheet, a printed matter with an organized layout can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2010-149479, filed Jun. 30, 2010, and No. 2011-095104, filed Apr. 21, 2011 which are hereby incorporated by reference herein in their entirety.

What is claimed is:

1. An image forming apparatus including a photosensitive section driven to rotate, a light emission unit configured to emit light to form electrostatic latent images on the photosensitive section and a process section configured to form images on the photosensitive section, the apparatus comprising:

a detection unit configured to detect an output generated via the process section when an electrostatic latent image for correction passes through a position facing the process section, the electrostatic latent image for correction being formed by emitting light by the light emission unit; and a control unit configured to execute a correction of a position of an electrostatic latent image in image formation based on a detection result from the detection unit.

2. The image forming apparatus according to claim 1, wherein the control unit corrects the position of the electrostatic latent image in image formation to bring a condition, in which the electrostatic latent image for correction is detected, closer to a reference condition.

3. The image forming apparatus according to claim 1, wherein the control unit corrects the position of the electrostatic latent image in image formation to return a condition, in which the electrostatic latent image for correction is detected, to a reference condition.

4. The image forming apparatus according to claim 1, further comprising a toner image detection unit configured to detect a toner image for correction, wherein the control unit is configured to correct a position of the electrostatic latent image in image formation based on a detection result from the toner image detection unit.

5. The image forming apparatus according to claim 1, further comprising a power supply unit for supplying power to the process section, wherein the output generated via the process section of when the electrostatic latent image for correction passes through the position facing the process section is an output of the power supply unit, and wherein the detection unit detects the output of the power supply unit.

6. The image forming apparatus according to claim 1, wherein the light emission unit forms electrostatic latent images for correction at a plurality of positions on the photosensitive section, wherein the detection unit respectively detects outputs generated via the process section when each of the electrostatic latent images for correction passes through a position facing the process section, and wherein the control unit corrects the position of the electrostatic latent image in image formation based on detection results from the detection unit.

7. The image forming apparatus according to claim 1, wherein the light emission unit forms electrostatic latent images for first correction at a plurality of positions on the photosensitive section, wherein the detection unit respectively detects outputs generated via the process section when each of the electrostatic latent images for first correction passes through a position facing the process section, wherein the control unit stores a detection result of each of the electrostatic latent images for first correction by the detection unit into a memory device, wherein the light emission unit forms electrostatic latent images for second correction at a plurality of positions on the photosensitive section under a predetermined condition, wherein the detection unit respectively detects outputs generated via the process section when each of the electrostatic latent images for second correction pass through a position facing the process section, and wherein the control unit corrects the position of the electrostatic latent image in image formation based on detection results of the electrostatic latent images for first correction and the electrostatic latent images for second correction by the detection unit.

8. The image forming apparatus according to claim 1, wherein the process section includes plural types of process units, wherein the plural types of process units include a first process unit to be a detection object of the detection unit and a second process unit provided on an upstream side of the first process unit, and wherein in a case where the electrostatic latent image for correction passes through a position facing the second process unit, the control unit controls the second process unit to move away from a position at which a toner image is formed, or to reduce an affect of the second process unit against the photosensitive section to be less than an affect in normal image formation.

9. The image forming apparatus according to claim 1, wherein the photosensitive section includes a plurality of photosensitive members, wherein an electrostatic latent image for correction is formed on each of the plurality of photosensitive members, wherein the detection unit is capable of detecting the plurality of photosensitive members in common, and wherein timings when the detection unit detects the plurality of photosensitive members are respectively different.

10. The image forming apparatus according to claim 1, wherein the photosensitive section includes a plurality of photosensitive members, wherein an electrostatic latent image for correction is formed on each of the plurality of photosensitive members, wherein the detection unit includes a plurality of detection devices, each of which corresponds to one of the plurality of photosensitive members, and wherein each of the plurality of detection devices is capable of detecting the electrostatic latent image for correction formed on one of the plurality of photosensitive members individually.

11. The image forming apparatus according to claim 1, wherein the photosensitive section includes a plurality of photosensitive members, wherein an electrostatic latent image for correction is formed on each of the plurality of photosensitive members, and wherein the control unit corrects misregistration between the plurality of photosensitive members by correcting positions of electrostatic latent images in image formation.

12. The image forming apparatus according to claim 1, wherein the correction of the position of the electrostatic latent image in image formation is executed by correction of timing of light emission by the light emission unit, or by correcting a rotation speed of the photosensitive section when the light emission unit emits a light onto the photosensitive section.

13. The image forming apparatus according to claim 1, wherein the detection unit detects a non-developed electrostatic latent image for correction.

14. An image forming apparatus including a photosensitive section driven to rotate and on which an electrostatic latent image for correction is formable, wherein the electrostatic latent image for correction is formed on a toner image formation area on which toner images are formable, the apparatus comprising:

a detection unit configured to detect the electrostatic latent image for correction that is formed on the photosensitive section and not developed, without being transferred; and a control unit configured to execute a correction of a position of an electrostatic latent image in image formation based on a detection result from the detection unit.

15. The image forming apparatus according to claim 14, further comprising a toner image detection unit configured to detect a toner image for correction, wherein the control unit is configured to correct a position of the electrostatic latent image in image formation based on a detection result from the toner image detection unit.

16. The image forming apparatus according to claim 14, wherein the control unit corrects the position of the electrostatic latent image in image formation to bring a condition, in which the electrostatic latent image for correction is detected, closer to a reference condition.

17. The image forming apparatus according to claim 14, wherein the control unit corrects the position of the electrostatic latent image in image formation to return a condition, in which the electrostatic latent image for correction is detected, to a reference condition.

18. The image forming apparatus according to claim 14, wherein the photosensitive section includes a plurality of photosensitive members, wherein an electrostatic latent image for correction is formed on each of the plurality of photosensitive members, wherein the detection unit is capable of detecting the plurality of photosensitive members in common, and wherein timings when the detection unit detects the plurality of photosensitive members are respectively different.

19. The image forming apparatus according to claim 14, wherein the photosensitive section includes a plurality of photosensitive members, wherein an electrostatic latent image for correction is formed on each of the plurality of photosensitive members, wherein the detection unit includes a plurality of detection devices, each of which corresponds to one of the plurality of photosensitive members, and wherein each of the plurality of detection devices is capable of detecting the electrostatic latent image for correction formed on one of the plurality of photosensitive members individually.

20. The image forming apparatus according to claim 14, wherein the photosensitive section includes a plurality of photosensitive members, wherein an electrostatic latent image for correction is formed on each of the plurality of photosensitive members, and wherein the control unit corrects misregistration between the plurality of photosensitive members by correcting positions of electrostatic latent images in image formation.

21. The image forming apparatus according to claim 14, further comprising:

a charging unit configured to charge the photosensitive section, a light emission unit configured to emit light to form electrostatic latent images on the photosensitive section, a development unit configured to develop the electrostatic latent images as the toner images, and a transfer unit configured to transfer the toner images on a transfer member, wherein the light emission unit is capable of forming the electrostatic latent image for correction, wherein the detection unit detects an output generated via the charging unit when the electrostatic latent image for correction passes through a position facing the charging unit, an output generated via the development unit when the electrostatic latent image for correction passes through a position facing the development unit, or an output generated via the transfer unit when the electrostatic latent image for correction passes through a position facing the transfer unit, and wherein the control unit corrects a position of the electrostatic latent image in image formation based on a detection result from the detection unit.

22. The image forming apparatus according to claim 21, further comprising a power supply unit for supplying a power to the charging unit, wherein the output generated via the charging unit when the electrostatic latent image for correction passes through the position facing the charging unit is an output of the power supply unit, and wherein the detection unit detects the output of the power supply unit.

23. The image forming apparatus according to claim 21, further comprising a power supply unit for supplying power to the development unit, wherein the output generated via the development unit when the electrostatic latent image for correction passes through the position facing the development unit is an output of the power supply unit, and wherein the detection unit detects the output of the power supply unit.

24. The image forming apparatus according to claim 21, further comprising a power supply unit for supplying power to the transfer unit, wherein the output generated via the transfer unit when the electrostatic latent image for correction passes through the position facing the transfer unit is an output of the power supply unit, and wherein the detection unit detects the output of the power supply unit.

25. The image forming apparatus according to claim 21, wherein the light emission unit forms electrostatic latent images for correction at a plurality of positions on the photosensitive section, wherein the detection unit respectively detects the output generated via the charging unit when each of the electrostatic latent images for correction passes through the position facing the charging unit, the output generated via the development unit of when each of the electrostatic latent images for correction passes through the position facing the development unit, or the output generated via the transfer unit of when each of the electrostatic latent images for correction passes through the position facing the transfer unit, and wherein the control unit corrects the position of an electrostatic latent image in image formation based on detection results from the detection unit.

26. The image forming apparatus according to claim 21, wherein the light emission unit forms electrostatic latent images for first correction at a plurality of positions on the photosensitive section, wherein the detection unit respectively detects outputs generated via the development unit when each of the electrostatic latent images for first correction passes through a position facing the development unit, wherein the control unit stores a detection result of each of the electrostatic latent images for first correction by the detection unit into a memory device, wherein the light emission unit forms electrostatic latent images for second correction at a plurality of positions on the photosensitive section under a predetermined condition, wherein the detection unit respectively detects outputs generated via the development unit when each of the electrostatic latent images for second correction passes through a position facing the development unit, and wherein the control unit corrects position of an electrostatic latent image in image formation based on detection results of the electrostatic latent images for first correction and the electrostatic latent images for second correction by the detection unit.

27. The image forming apparatus according to claim 21, wherein the development unit is provided on an upstream side of the charging unit as a detection object of the detection unit in a direction in which an electrostatic latent image moves, and wherein in a case where the electrostatic latent image for correction passes through a position facing the development unit, the control unit controls the development unit to move away from a position at which a toner image is formed, or to reduce an affect of the development unit against the photosensitive section to be less than an affect in normal image formation.

28. The image forming apparatus according to claim 21, wherein the development unit is provided on an upstream side of the transfer unit as a detection object of the detection unit in a direction in which an electrostatic latent image moves, and wherein in a case where the electrostatic latent image for correction passes through a position facing the transfer unit, the control unit controls the transfer unit to move away from a position at which a toner image is formed, or to reduce an affect of the transfer unit against the photosensitive section to be less than an affect in normal image formation.

29. The image forming apparatus according to claim 21, wherein the correction of the position of the electrostatic latent image in image formation is executed by correction of timing of light emission by the light emission unit, or by correcting a rotation speed of the photosensitive section when the light emission unit emits the light onto the photosensitive section.

30. An image forming apparatus in which an electrostatic latent image for correction and a toner image for correction are formable, the apparatus comprising:

a first detection unit configured to detect the electrostatic latent image for correction;

a second detection unit configured to detect the toner image for correction; and a control unit configured to execute a first correction for correcting a position at which an electrostatic latent image is formed in image formation based on a detection result from the first detection unit, and a second correction for correcting a position at which an electrostatic latent image is formed in image formation based on a detection result from the second detection unit.

31. The image forming apparatus according to claim 30, comprising a plurality of photosensitive members, wherein electrostatic latent images for correction are formed on the plurality of photosensitive members, and wherein the electrostatic latent images for correction are formed by one or more predetermined patterns, respectively, on the plurality of photosensitive members.

* * * * *